US005502423A

United States Patent [19]

Okude et al.

[11] Patent Number: 5,502,423

[45] Date of Patent: Mar. 26, 1996

[54] DISCHARGE LAMP LIGHTING DEVICE

[75] Inventors: Akio Okude; Tokushi Yamauchi; Kei Mitsuyasu; Yoshifumi Kuroki; Naoki Ohnishi; Katsuyuki Kiyozumi, all of Kadoma, Japan

[73] Assignee: Matsushita Electric Works, Ltd., Osaka, Japan

[21] Appl. No.: 231,148

[22] Filed: Apr. 22, 1994

[30] Foreign Application Priority Data

Apr. 23, 1993 [JP] Japan ..... 5-098200
Aug. 11, 1993 [JP] Japan ..... 5-199814

[51] Int. Cl.[6] ..... H05E 37/02

[52] U.S. Cl. ..... 315/291; 315/209 R; 315/219

[58] Field of Search ..... 315/209 R, 219, 315/269, 174, 291, 307, DIG. 7

[56] References Cited

U.S. PATENT DOCUMENTS 4,392,087 7/1983 Zansky ..... 315/219
4,461,981 7/1984 Saikatsu et al. ..... 315/246
4,564,897 1/1986 Okamoto et al. ..... 363/132
4,791,338 12/1986 Dean et al. ..... 315/174
4,933,605 6/1990 Quazi et al. ..... 315/224
4,933,831 6/1990 Takahashi et al. ..... 363/132
4,952,849 8/1990 Fellows et al. ..... 315/307
5,001,400 3/1991 Nilssen ..... 315/209 R
5,051,662 9/1991 Counts ..... 315/247
5,063,490 11/1991 Maehara et al. ..... 315/307
5,144,195 9/1992 Konopka et al. ..... 315/94
5,170,099 12/1992 Ueoka et al. ..... 315/291
5,182,702 1/1993 Hiramatsu ..... 363/132

*Primary Examiner*—Robert J. Pascal
*Assistant Examiner*—Darius C. Gambino

[57] ABSTRACT

A discharge lamp lighting device has first switching means for converting AC power into DC power and second switching means for converting the DC power into a high frequency power, the first switching means being driven subsequently to a driving of the second switching means, and the device is arranged for intermittently applying a pulse voltage to a discharge lamp during its dimming lighting, whereby any secondary voltage can be effectively lowered and any flash apt to occur during the dimming lighting can be restrained.

21 Claims, 22 Drawing Sheets

DISCHARGE LAMP LIGHTING DEVICE

BACKGROUND OF THE INVENTION

This invention relates to a discharge lamp lighting device for high-frequency lighting of a discharge lamp with an inverter circuit employed.

DESCRIPTION OF RELATED ART

Generally, in the discharge lamp lighting device, a high voltage required for starting the discharge is applied to the discharge lamp in starting the same. In the case when the discharge lamp lighting device is made to be capable of carrying out a dimming lighting of the discharge lamp, it is required, for starting the lamp in dimming state, to provide to the lamp upon starting the dimming lighting an energy larger than that for maintaining the dimming lighting, and there arises a problem that the dimming lighting involves a flash occurring accompanying the larger energy provided.

In particular, when the dimming lighting is to be started for such lighting at a relative ratio of illumination less than 50% with respect to the illumination under the rated lighting made to be 100%, the problem of such flash is remarkable.

An example of the discharge lamp lighting device for lighting the discharge lamp with a high frequency obtained by means of the inverter circuit and for improving the device in respect of any input distortion by means of a chopper circuit has been disclosed in U.S. Pat. No. 5,144,195, in which, upon starting, filaments of the discharge lamp are preheated for a period from an oscillation of the inverter circuit to a starting of the chopper circuit so as to prolong the life of the discharge lamp and to reduce secondary voltage at the time of any abnormality. However, this device still fails to provide any technical idea of executing a dimming lighting of the discharge lamp nor of preventing any flash from occurring upon starting of the dimming lighting.

On the other hand, another example of the discharge lamp lighting device arranged for the dimming lighting has been disclosed in U.S. Pat. No. 4,392,087, in which the device is constituted for realizing the dimming by means of a phase control. However, this device has involved a difficulty in realizing the dimming lighting while maintaining a stable lighting state, and still fails to provide any chopper arrangement capable of restraining any input distortion nor to disclose any technical matter capable of restraining the flash occurring upon starting of the dimming lighting.

Another device arranged for reducing the secondary voltage at the time of starting the lighting of the discharge lamp or at a no-load state has been disclosed in U.S. Pat. No. 4,952,849, in which the secondary voltage is reduced by gradually lowering an oscillation frequency of the inverter circuit upon the starting so as to light the discharge lamp but by raising the frequency at the no-load state. However, in this known device, too, the technical idea of the dimming lighting including the measure for restraining the flash upon starting of the dimming has been failed to be shown.

In another U.S. Pat. No. 4,461,980, the device is shown to be arranged for reducing the effective value of the secondary voltage by intermittently oscillating the inverter circuit at the no-load state, but this device has been also failing to provide the technical idea for the dimming lighting, including any measure for restraining the flash upon starting the dimming.

Further, in a U.S. Pat. No. 4,791,338, there has been described a device in which a pulse voltage is provided to the secondary voltage upon starting the lighting of the discharge lamp, but there has been a problem that the flash occurring upon starting the dimming lighting of the lamp is difficult to be reliably restrained merely by providing the pulse voltage to the secondary voltage.

In addition, U.S. Pat. No. 5,170,099 suggests to realize a stable lighting of the discharge lamp even in a state of low light flux dimming, by means of an application of a DC voltage to the discharge lamp upon the dimming lighting. With this known device, however, there has been still involved a problem that the flash occurring upon starting the dimming lighting cannot be reliably avoided.

SUMMARY OF THE INVENTION

A primary object of the present invention is, therefore, to provide a discharge lamp lighting device which is capable of restraining the input distortion by lighting the discharge lamp with a high frequency, of preventing the flash from occurring upon starting the dimming lighting, and thus of realizing a stable dimming lighting of the discharge lamp even in such state of low flux of light as the relative illumination ratio of less than 1%.

According to the present invention, the above object can be realized by a discharge lamp lighting device in which an AC power from an AC source is converted through a first switching means into a DC power, which DC power is converted through a second switching means into a high frequency power, a load circuit including a discharge lamp is connected to output terminals of the second Switching means, and the first switching means is made to be driven subsequently to a driving of the second switching means, characterized in that a pulse-shaped voltage is intermittently applied by a voltage applying means to the discharge lamp upon its dimming lighting.

With the above described arrangement according to the present invention, it is made possible to effectively lower the secondary voltage by the intermittent application of the pulse-shaped voltage upon starting the dimming or upon dimming-lighting, and in particular to effectively prevent the flash from occurring upon starting the dimming.

Other objects and advantages of the present invention shall become clear from following description of the invention detailed with reference to preferred embodiments shown in accompanying drawings.

While the present invention shall now be explained with reference to the respective embodiments shown in the accompanying drawings, it will be appreciated that the intention is not to limit the invention only to the embodiments shown but rather to include all alterations, modifications and equivalent arrangements possible within the scope of appended claims.

DETAILED DESCRIPTION OF THE PREFERRED EMBODIMENTS

Figure 1:
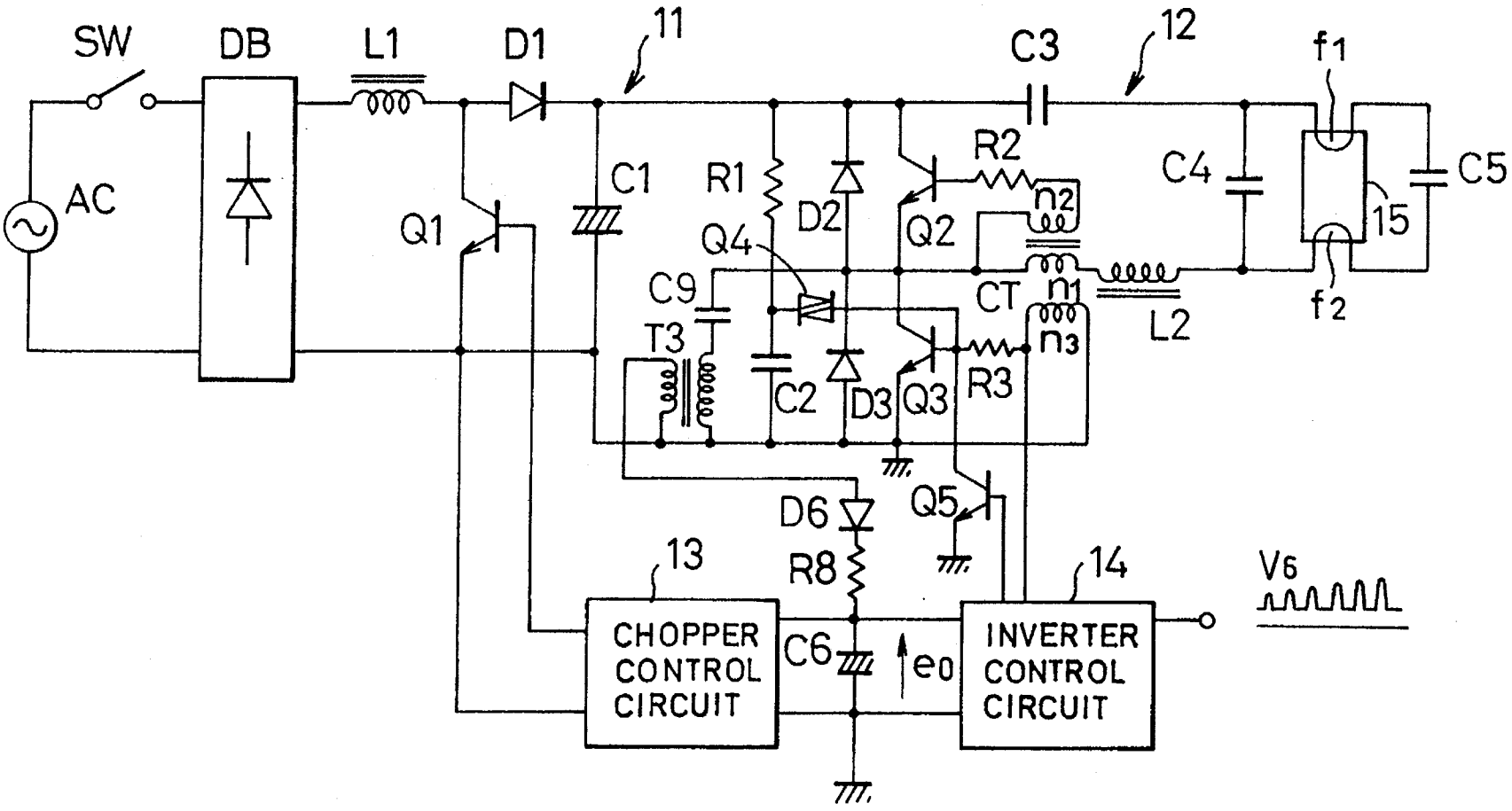
FIG. 1 is a circuit diagram of the discharge lamp lighting device in an embodiment according to the present invention.
Figure 2:
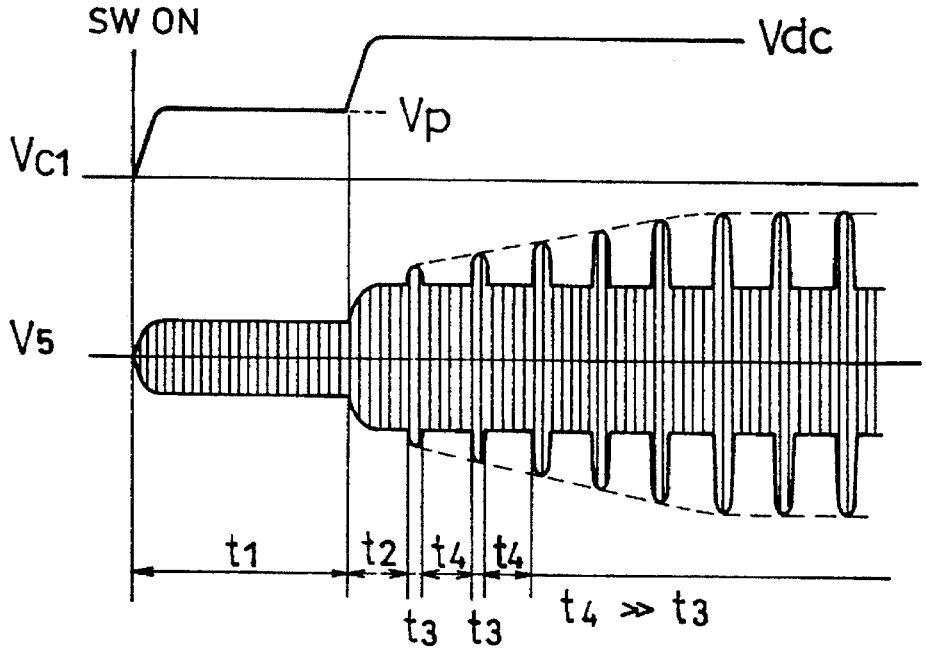
FIG. 2 is a waveform diagram for showing the operation of the lighting device in FIG. 1.

FIG. 1 shows an embodiment of the discharge lamp lighting device according to the present invention, and FIG. 2 shows operational waveforms for this embodiment, in which a boosting chopper circuit 11 is kept in a standstill state for a period $t_1$ after a closure of source switch SW with respect to an AC source AC. Here, a smoothed DC voltage $V_{cl}$ applied through means DB for rectifying an AC source voltage into a DC voltage to an inverter circuit 12 is made to be at a peak value Vp while a voltage $V_5$ applied to a discharge lamp 15 is made small in the amplitude, so that a sufficient preheating current is provided to the discharge lamp 15 without causing the lamp to start the discharge. After this preheating of the discharge lamp 15, the boosting chopper circuit 11 is actuated to have the smoothed DC voltage Vp to the inverter circuit 12 boosted to be at a voltage Vdc. In this respect, the arrangement is so made that the voltage will be boosted at a ratio of a level not lighting the discharge lamp 15 or, even when the boosting ratio is made large, ON period of switching elements Q2 and Q3 in the inverter circuit 12 is controlled to restrain the voltage to be at a level not starting the discharge. Thereafter, the voltage $V_5$ is increased only in every period $t_3$ to have a pulse-shaped voltage applied intermittently to the discharge lamp 15 through the inverter 12, and this pulse-shaped voltage is to be so controlled that its level will be gradually elevated until a voltage at which the discharge lamp 15 starts discharging is reached.

The present embodiment shall be further detailed, including the operation of the entire circuit shown in FIG. 1. Now, as the source switch SW is made ON, the AC source voltage from the source AC is rectified by the rectifying means DB, and the DC voltage smoothed by a capacitor C1 is applied through a diode D1 to the inverter circuit 12. At this time, a switching element Q1 included in the chopper circuit 11 is kept in non-conducting state, and no chopper action is executed. Here, as the voltage at the capacitor C1 is supplied to the inverter circuit 12, a capacitor C2 receives this voltage through a resistor R1 to be charged thereby. As the charged voltage in the capacitor C2 reaches a breakover voltage of a DIAC Q4, the charge accumulated in the capacitor C2 is discharged through base and emitter of the switching element Q3, so that this switching element Q3 will be thereby turned ON. Thereafter, feedback currents from secondary windings n2 and n3 of a current feedback transformer CT are provided respectively through each of resistors R2 and R3 to each base of the switching elements Q2 and Q3 so that these switching elements Q2 and Q3 will be alternately turned ON and OFF.

At this time, such voltage that will be switched in direct-current system is generated across the collector and emitter of the switching element Q3, and this voltage is applied through a coupling capacitor C9 to a primary winding of a transformer T3. With this coupling capacitor C9, any DC component is cut, and a high frequency AC component is made to flow through a secondary winding of the transformer T3. Accordingly, a high frequency AC voltage is thus obtained at the secondary winding of the transformer T3, which voltage is rectified and smoothed by a resistor R8 and capacitor C6, and a driving power for a chopper control circuit 13 can be obtained. With the primary and secondary windings of the transformer T3 optimumly selected in respect of the number of turns, it is made possible that such driving power as a DC voltage $e_0$ can be obtained for the chopper control circuit 13.

As the chopper control circuit 13 is actuated, the switching element Q1 in the boosting chopper circuit 11 is made ON and OFF. Accompanying this actuation of the chopper circuit 11, its relatively high output voltage causes the inverter circuit 12 to be driven thereby. In the event where the circuit is in stationary state at this time, a relatively high voltage of a high frequency is applied, through a resonance circuit constituted by an inductor L2 and capacitors C3 and C4, to the discharge lamp 15 provided with a preheating capacitor C5.

More concretely, the foregoing control of the pulse-shaped voltage may be realized by varying the 0N period of the switching element Q3 in the inverter circuit 12 in accordance with a pulse-shaped signal voltage V6 applied to an associated inverter control circuit 14, for intermittent oscillations. That is, the switching element Q3 can be forcibly made OFF by turning a switching element Q5 within the ON period of the switching element Q3, the element Q5 being inserted between the base of the switching element Q3 and the circuit 14, so that the 0N period of the switching element Q3 can be varied. Due to this variation, the ON periods of both switching elements Q2 and Q3 are unbalanced while the oscillation frequency is also varied, and the output of the inverter circuit 12 can be varied over a wide range. According to the present embodiment, it is made possible to start the dimming involving no flash even under the low flux of light of the relative illumination ratio less than 0.5%.

While in the foregoing embodiment of FIGS. 1 and 2 the arrangement in which the inverter circuit is connected in series system has been employed, it is also effective to employ a single-stone (single switching element) inverter circuit or a circuit of push-pull system.

Figure 3:
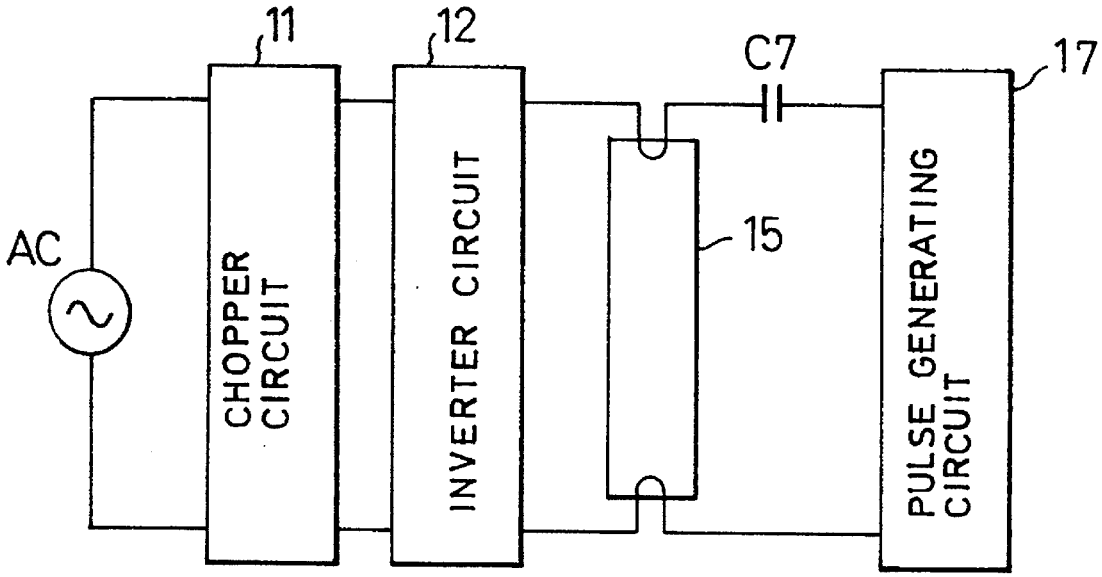
FIG. 3 is a block diagram showing another embodiment of the discharge lamp lighting device according to the present invention.
Figure 4:
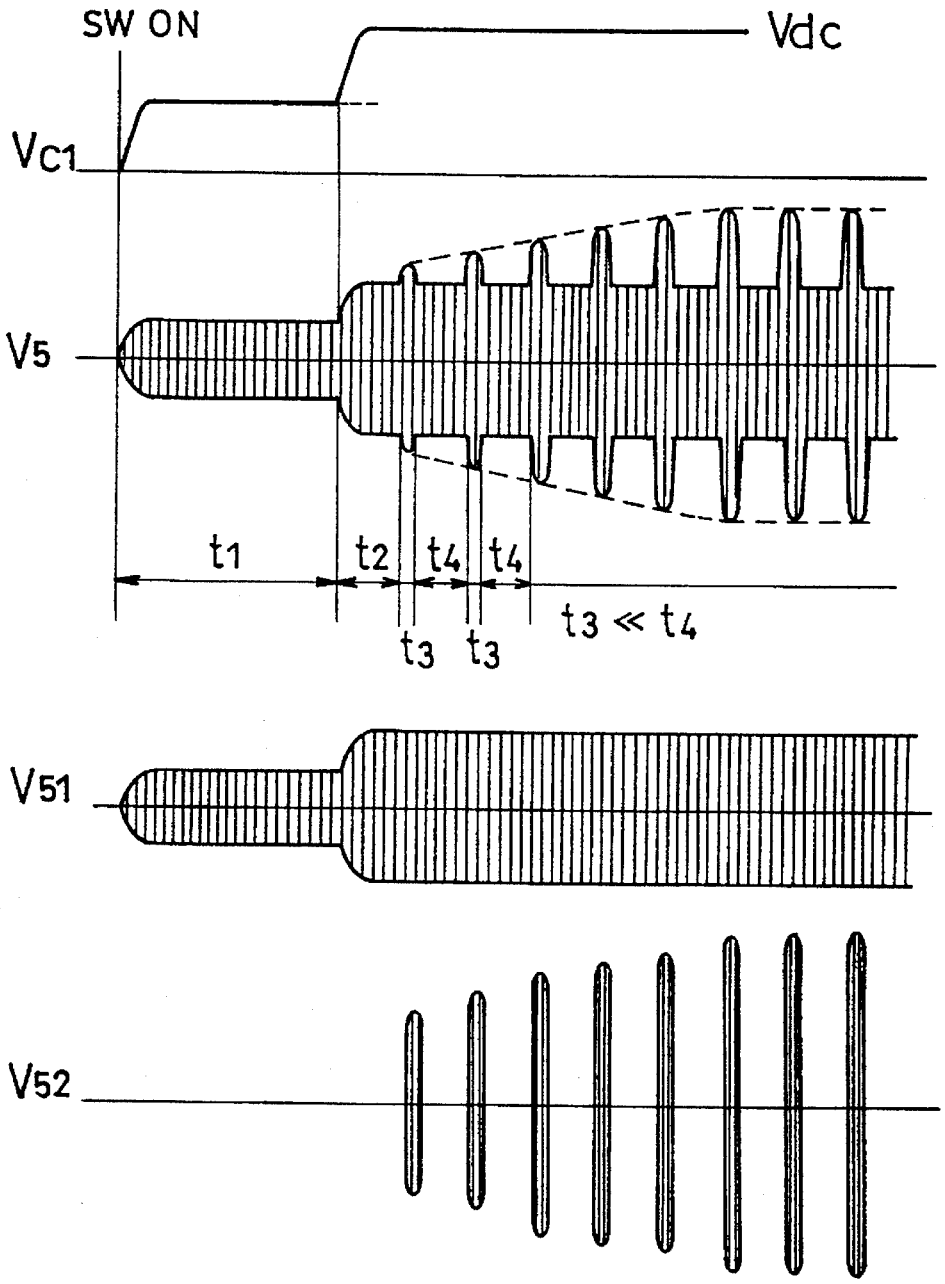
FIG. 4 is an operational waveform diagram for the embodiment shown in FIG. 3.

In FIG. 3, there is shown another embodiment of the discharge lamp lighting device according to the present invention, which operates with such waveforms as shown in FIG. 4, and this embodiment has in particular a pulse generating circuit 17 is inserted in the load circuit including the discharge lamp 15. Also in this case, the inverter circuit 12 is driven precedent to the chopper circuit 11 upon or after connection of the AC source AC, and the preheating current is made to flow to the discharge lamp 15. Thereafter, the chopper circuit 11 is driven to have the smoothed DC voltage Vcl boosted. Here, the voltage $V_{51}$ applied to the discharge lamp 15 is made low by keeping the voltage boosting ratio of the chopper circuit 11 to be low or the ON period of the switching element in the inverter circuit 12 to be short, so as to keep the energy supplied to the discharge lamp 15 to be relatively small. Now, with respect to this voltage $V_{51}$, a pulse-shaped voltage $V_{52}$ is added by means of the pulse generating circuit 17, upon which the lamp voltage $V_5$ is made to be $V_5=V_{51}+V_{52}$ and the same effect as in the embodiment of FIG. 1 can be established. The pulse-shaped voltage applied to the discharge lamp 15 may be synchronized with the output of the inverter circuit 12 or, without such synchronization, may be a voltage of a wide pulse width. Further, the inverter circuit 12 in the embodiment of FIG. 3 may also employ certain other circuit arrangement as in the embodiment of FIG. 1.

Figure 5:
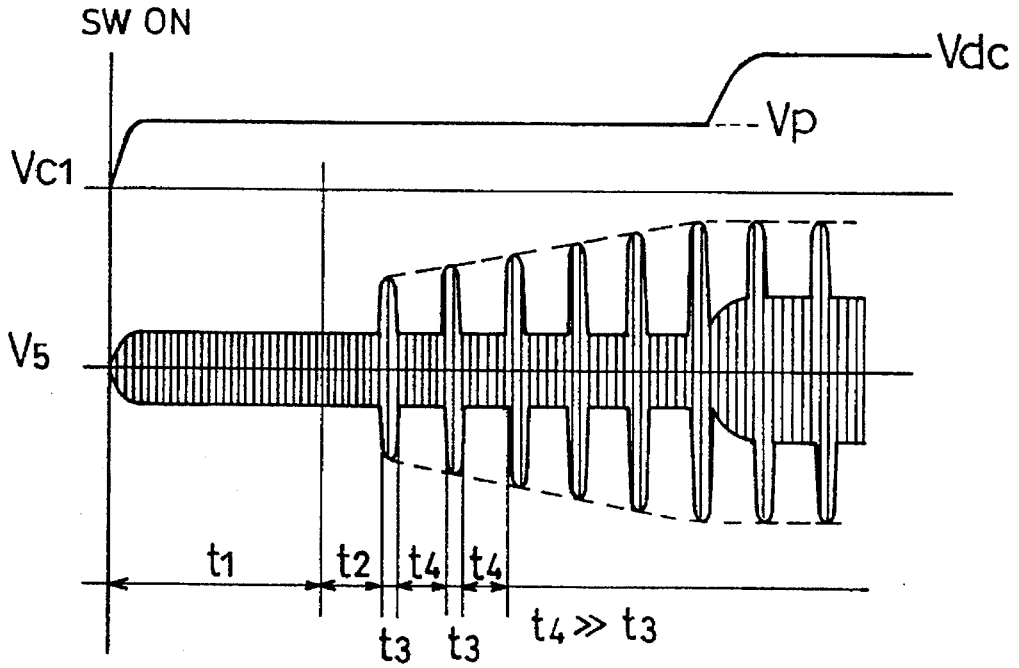
FIGS. 5 to 8 are operational waveform diagrams respectively for each of other embodiments of the discharge lamp lighting device according to the present invention.

FIG. 5 is a waveform diagram for another embodiment of the present invention. While, in the foregoing embodiment of FIG. 4, the inverter circuit 12 is actuated to have the discharge lamp 15 preheated precedently and thereafter the chopper circuit 11 starts operating so as to have the pulse-shaped voltage applied to the discharge lamp 15, the present embodiment executes the preheating of the discharge lamp 15 through the inverter circuit 12 after the connection of the source AC, and subsequently the application of the pulse-shaped voltage. With this application of the pulse-shaped voltage, it is made possible to realize the low light-flux dimming start in smooth manner. Next, the chopper circuit 11 is driven when the pulse-shaped voltage becomes stable in the magnitude. With the actuation of the chopper circuit 11 at such timing, the discharge lamp 15 starts discharging and, since the discharge lamp is already in a state capable of being stably lit, the chopper circuit 11 operates in a relatively stable manner. Further, since the discharge lamp 15 is in the lit state of the low light-flux dimming and is consuming the electric power, an overshoot voltage occurring when the output voltage Vcl of the chopper circuit 11 rises to the boosted voltage Vdc is made relatively hard to be generated. It should be appreciated that the above arrangement is employable not only in the foregoing embodiment of FIG. 1 or 3 but also in any other circuits which adopting arrangement for the dimming lighting, with the same effect obtained.

Figure 6:
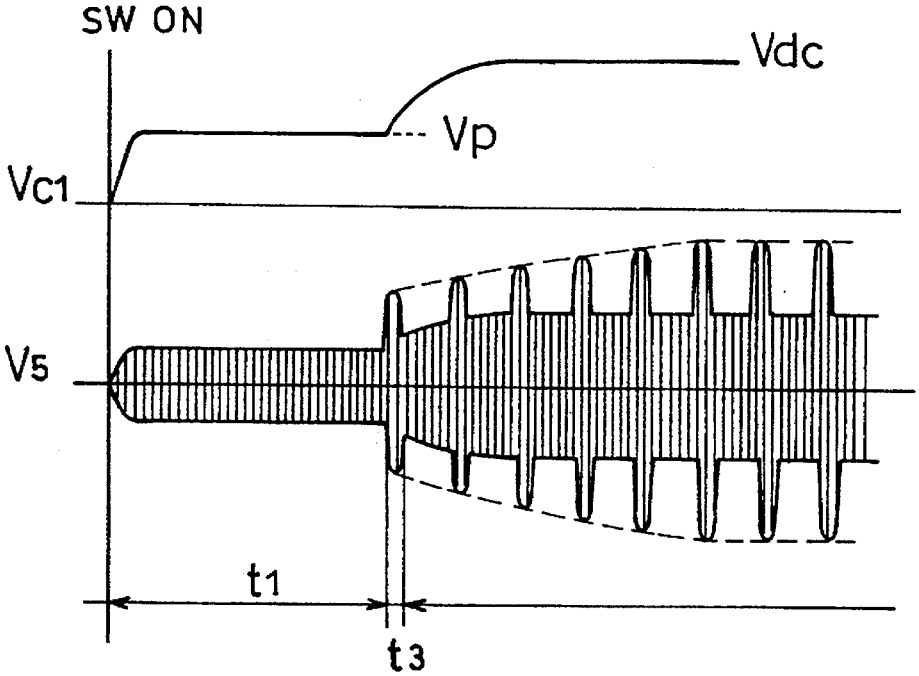

FIG. 6 shows operational waveforms for another embodiment of the discharge lamp lighting device according to the present invention, in which, as will be clear from the waveforms, the chopper circuit 11 is actuated at the same time when the pulse-shaped voltage is applied. With the circuit operation at this timing, the pulse-shaped voltage is applied from starting point of the chopper circuit 11 so that the energy supplied to the load circuit is made larger, and it is made possible to prevent the overshoot voltage that appears in the chopper output voltage Vcl from occurring upon starting the chopper circuit 11. Further, as the chopper circuit 11 is started at the same time when the pulse-shaped voltage is applied, the effective value of the applied voltage to the discharge lamp 15 is made smoothly larger after contribution to the precedent preheating. Therefore, in addition to the improvement in the startability as a result of the application of the pulse-shaped voltage, the level of basic application is also made to gradually rise, and a further smooth lighting than the foregoing operation referred to with reference to FIG. 2 can be realized.

Figure 7:
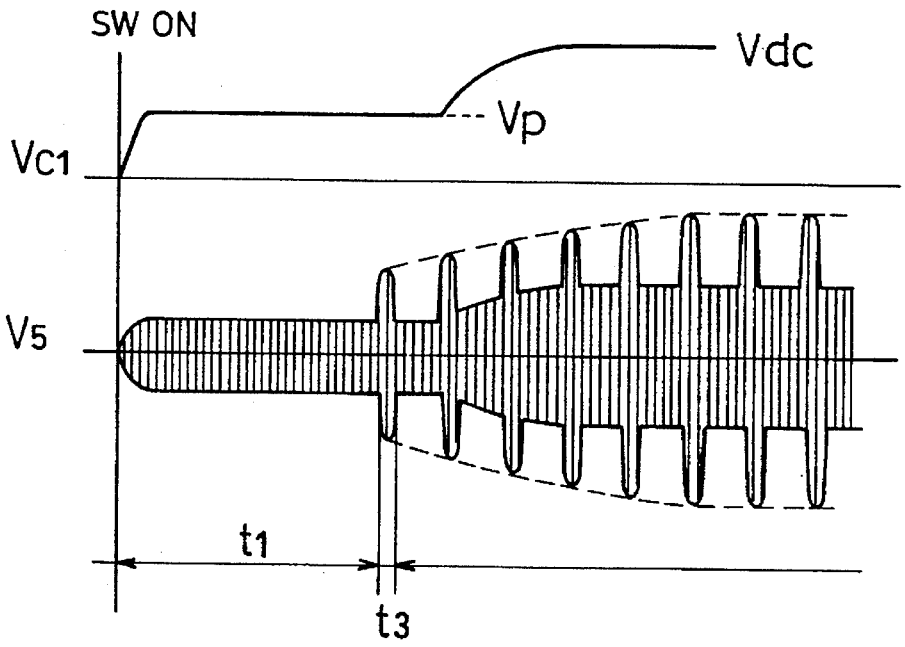

In FIG. 7, there is shown operational waveforms for another embodiment of the discharge lamp lighting device according to the present invention, in which, as w will be also clear from the waveforms, the inverter circuit 12 is actuated after the connection of the source for the precedent preheating of the discharge lamp 15, then the application of the pulse-shaped voltage is initiated and, in the process where the peak value of the pulse-shaped voltage gradually rises, the operation of the chopper circuit 11 is initiated. With the circuit operation carried out at such timing, the application of the pulse-shaped voltage has been already started at the time when the chopper circuit 11 is started so that the energy provided to the load circuit would be large, the overshoot voltage appearing upon rising of the chopper-circuit output voltage Vcl to the boosted voltage Vdc is made comparatively hard to occur. Further, since in the present embodiment the output voltage Vcl of the chopper circuit 11 is enlarged in the process of gradually enlarging the pulse-shaped voltage, it is possible to execute the smooth starting of the discharge in similar manner to the foregoing embodiment of FIG. 6. Further, as the amplitude of the basic wave is enlarged at a point where a difference of the peak value of the pulse-shaped voltage from the voltage of the basic wave, the difference between the voltages can be kept not excessively large, any stress to the circuit can be reduced and any noises or the like can be effectively prevented from occurring.

Figure 8:
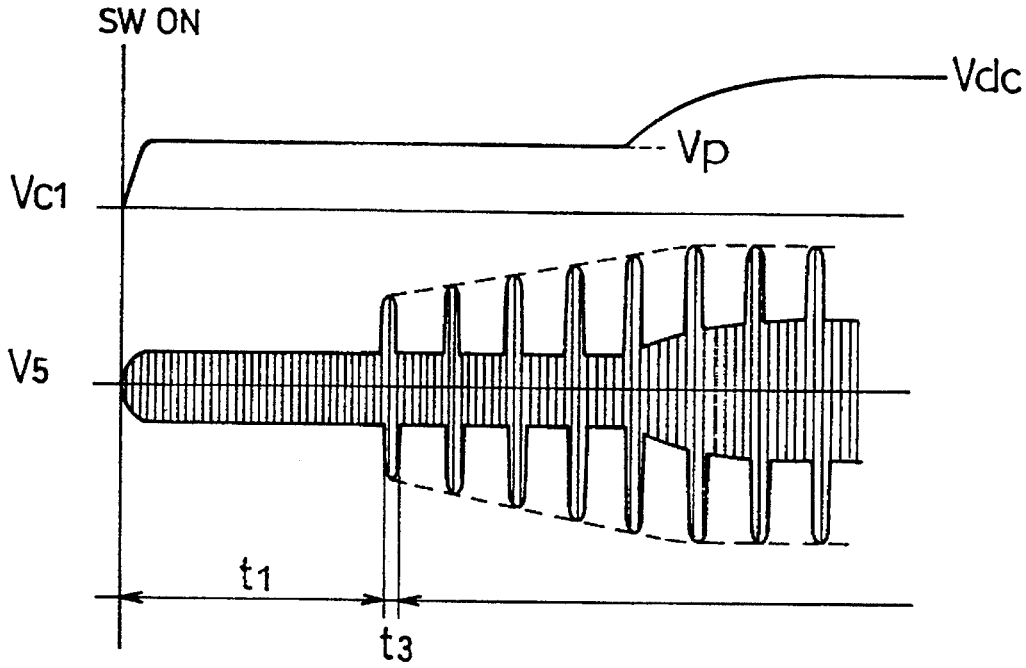
Figure 9:
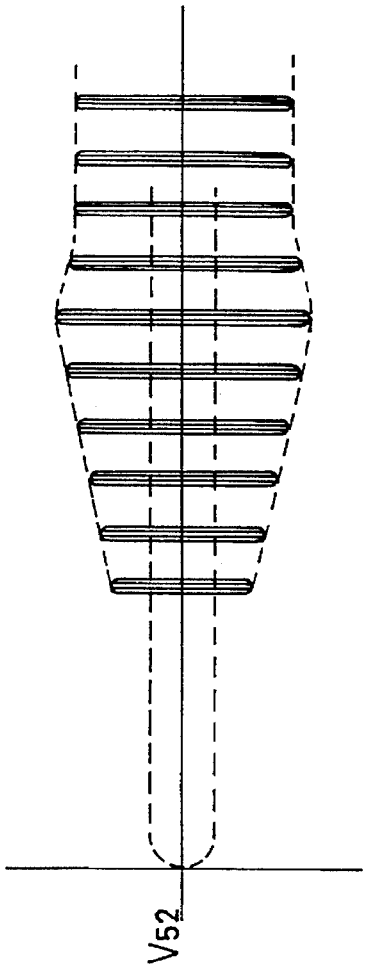
FIG. 9 is a waveform diagram for another aspect of the discharge lamp lighting device according to the present invention.

FIG. 8 shows operational waveforms of another embodiment of the discharge lamp lighting device according to the present invention, in which, as will be clear from the waveforms, the inverter circuit 12 is actuated after the connection of the source for the precedent preheating of the discharge lamp 15, then the pulse-shaped voltage is kept applied before the actuation of the chopper circuit 11, which actuation of the circuit 11 is executed before the peak value of the pulse-shaped voltage is stabilized, and the boosted output voltage Vdc of the chopper circuit 11 is stabilized after the stabilization of the pulse-shaped voltage. With the operation of the device at this timing, the overshoot voltage occurring upon rising of the chopper-circuit output voltage Vcl to the boosted voltage Vdc can be effectively prevented from occurring. Further, in the present embodiment, the actuation of the chopper circuit 11 is made at the time when the peak value of the pulse-shaped voltage approaches the maximum value, so that the applied voltage $V_5$ to the discharge lamp 15 as the effective value will be made larger. Accordingly, the effective value of the lamp voltage $V_5$ is caused to be elevated at a point close to the starting of the discharge by the application of the pulse-shaped voltage at such state as a low temperature state or the like where the discharge is hard to be started, and the lighting operation can be realized in smooth manner even at the low temperature or the like state. Further, the low light-flux dimming lighting can be effectively maintained by the application of the pulse-shaped voltage upon starting the lighting, in stable manner without causing any flickering. In this case, as shown also in FIG. 9, the device may be so arranged that the pulse-shaped voltage is made to reach the peak value at a point close to the starting of the discharge lighting, and the same effect can be attained so long as the timing of the operation of the chopper circuit 11 is taken to be the same as in the above.

Figure 10:
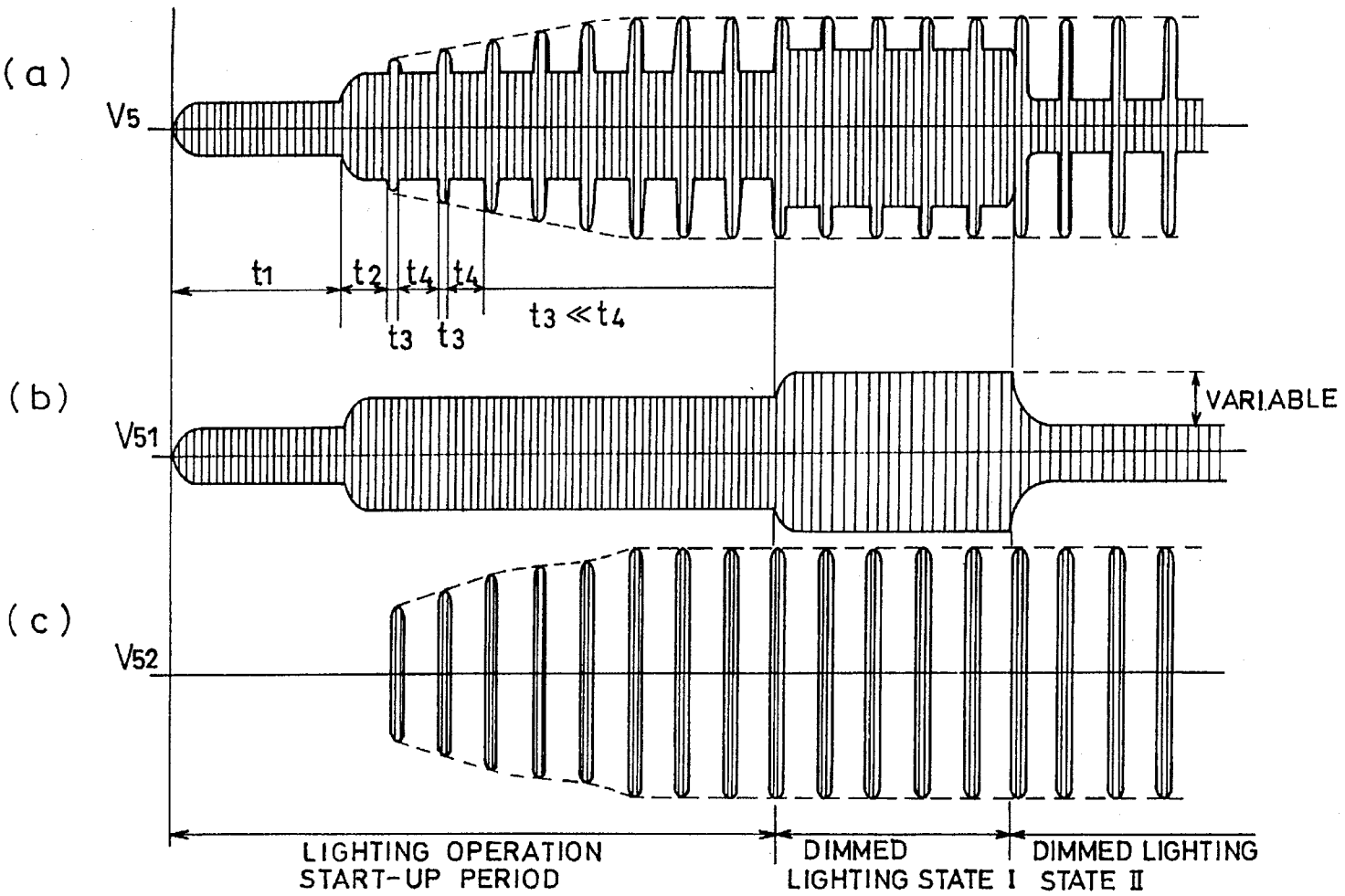
FIGS. 10 to 12 are operational waveform diagrams for further embodiments of the discharge lamp lighting device according to the present invention.

FIG. 10 shows operational waveforms in another embodiment of the discharge lamp lighting device according to the present invention, in which the arrangement is so made that, at the time of the low light-flux dimming lighting, the low light-flux lighting can be stably maintained by applying the same pulse-shaped voltage as that for starting the lighting. As shown in the drawing, in this case, the effective value of the voltage applied to the discharge lamp is varied by an optional variation of the lamp voltage $V_{51}$, in consequence of which a consecutive dimming down to the low light-flux is made possible and, even during the low light-flux lighting, a stable lighting state can be maintained.

Figure 11:
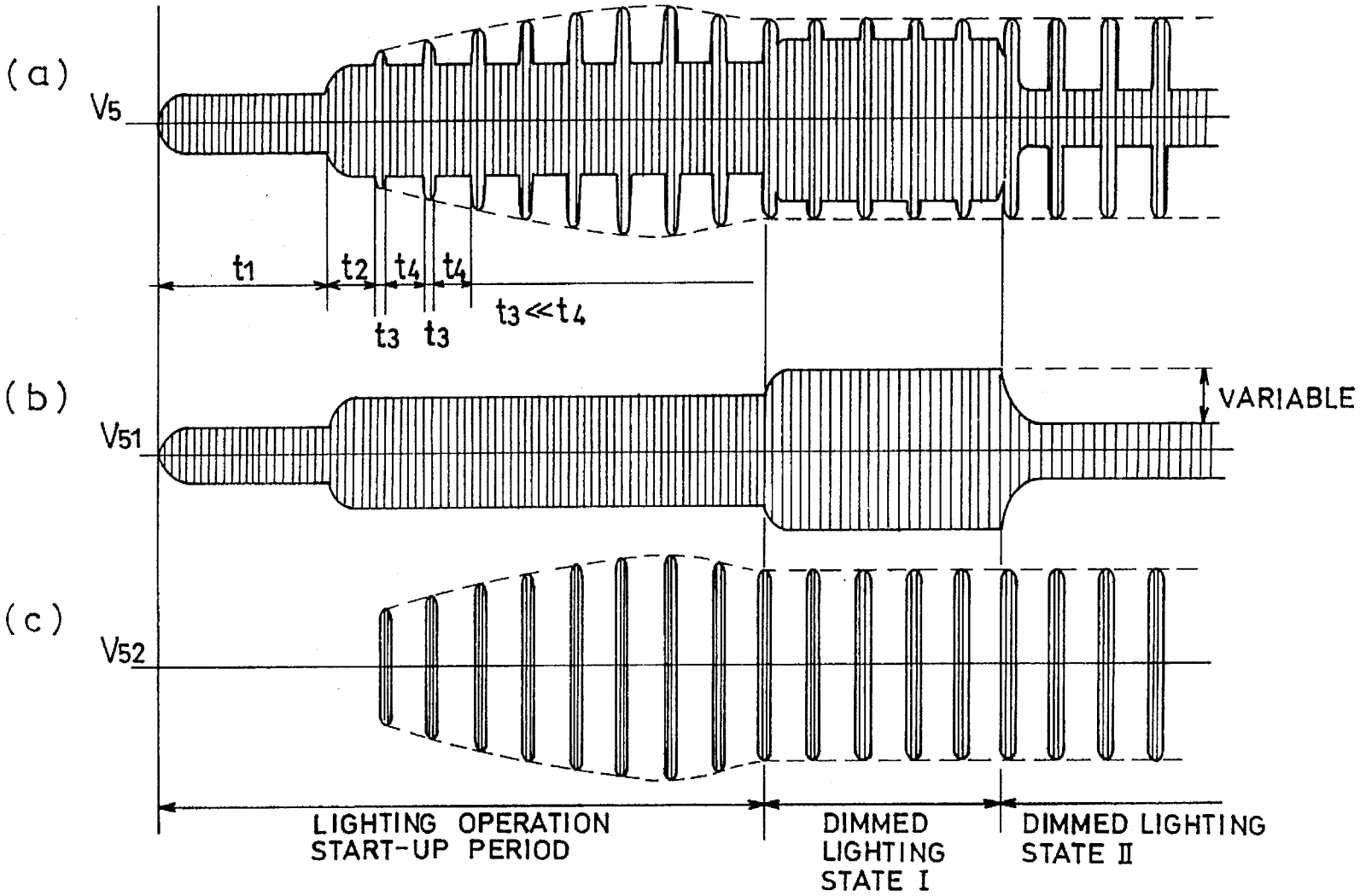

FIG. 11 shows operational waveforms in another embodiment of the discharge lamp lighting device according to the present invention. Referring back to the embodiment of FIG. 10, the use of the same pulse-shaped voltage at the time of both of the low light-flux dimming lighting and the starting of the lighting may cause a risk to arise so that the peak value of the pulse becomes excessively high, the power consumed at the discharge lamp upon application of the pulse-shaped voltage is increased, and the low light-flux dimming lighting becomes impossible in a state below a predetermined dimming ratio even when the level of the lamp voltage $V_{51}$ is lowered. In this respect, the voltage application upon starting the dimming lighting is made at a level required therefor, whereas, after the light-up of the discharge lamp, the voltage is gradually varied as shown in FIG. 11 to the minimum required level of the pulse-shaped voltage for maintaining the stable lighting of the discharge lamp at the time of the low light-flux dimming lighting, and the range of the low light-flux capable of maintaining the lighting can be sufficiently expanded. According to the present embodiment, it is possible to start the dimming involving no flash even under the low flux of light of the relative illumination ratio less than 0.5%, and to realize a continuous dimming to the low flux of light of the relative illumination ratio under 0.5%.

Figure 12:
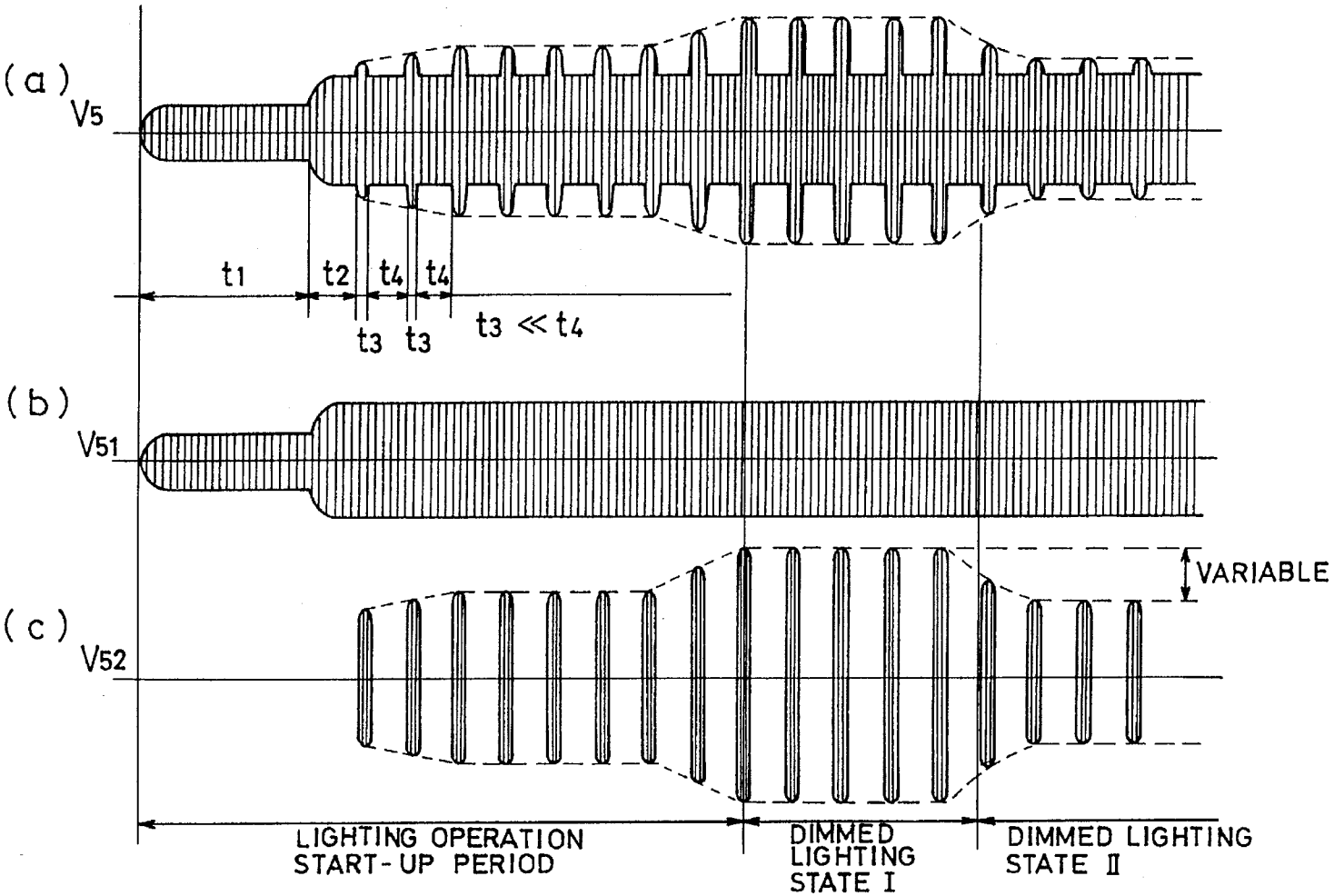

In FIG. 12, there are shown operational waveforms in another embodiment of the discharge lamp lighting device according to the present invention, in which the arrangement is so made that, upon the dimming lighting, a higher pulse-shaped voltage than that for starting the lighting is applied. Now, in an event where such pulse-shaped voltage as shown in FIG. 12 is applied, it is made possible to have the discharge lamp lit as dimmed at a certain dimming ratio and, when the pulse-shaped voltage upon the dimming is optionally varied, it is also possible to vary the dimming ratio in accordance with the pulse-shaped voltage.

Figure 13:
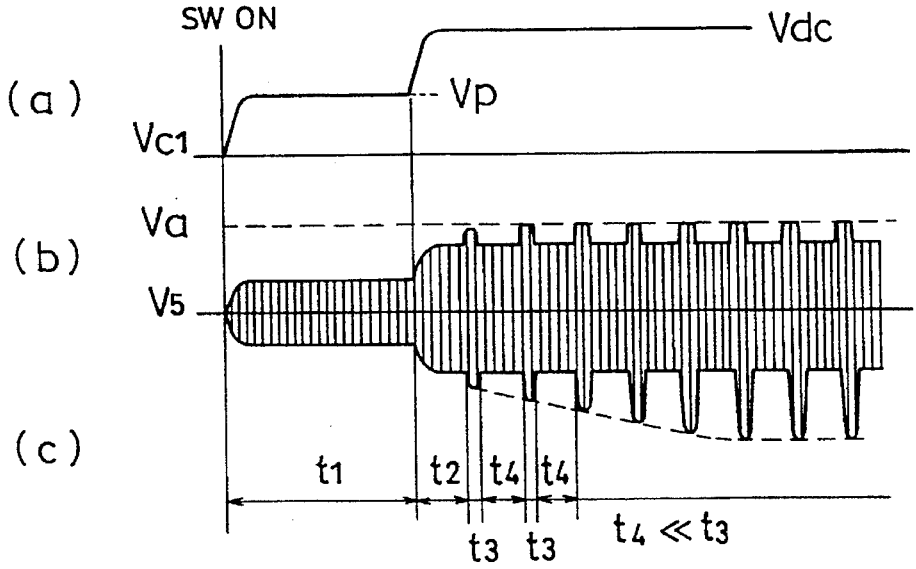
FIG. 13 is an operational waveform diagram for another aspect of the discharge lamp lighting device according to the present invention.

While in the respective foregoing embodiments the pulse-shaped voltages for the starting of lighting and for the dimming lighting have been shown to be symmetrical in respect of the positive and negative sides, such asymmetrical pulse-shaped voltage as shown in FIG. 13 may also be applied.

Figure 14:
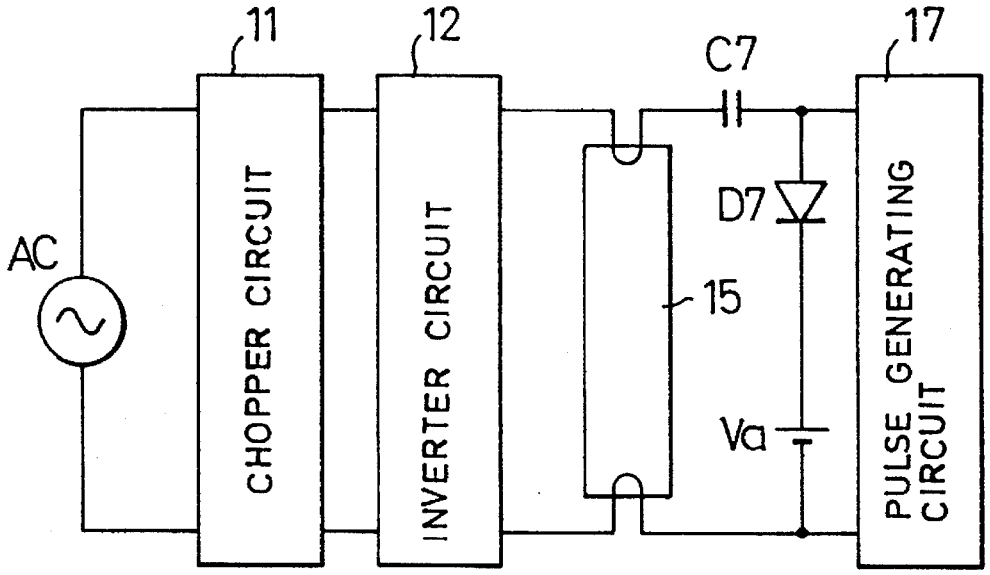
FIG. 14 is a block diagram showing another embodiment of the discharge lamp lighting device according to the present invention.
Figure 15:
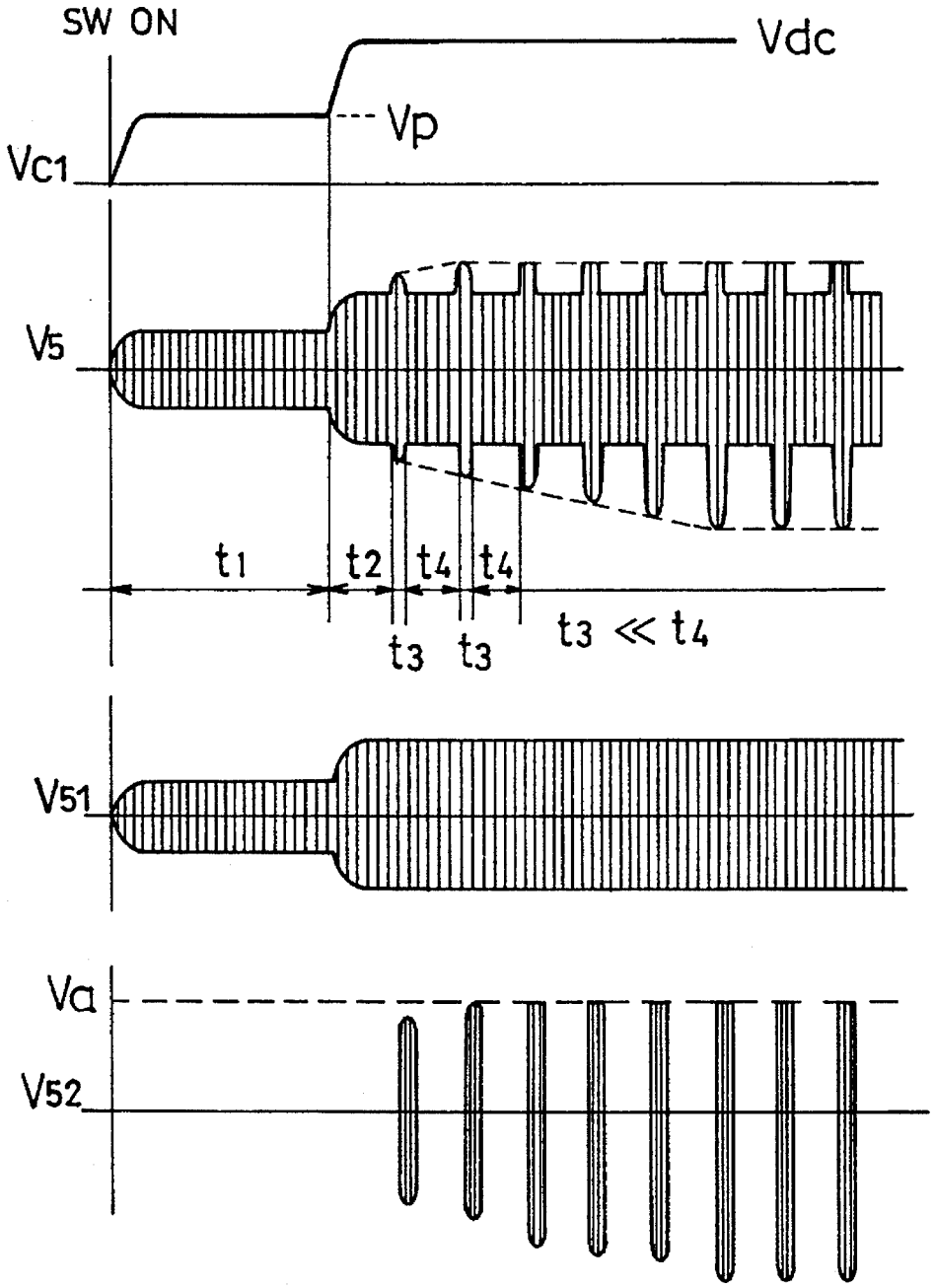
FIG. 15 is an operational waveform diagram for the embodiment of FIG. 14.
Figure 16:
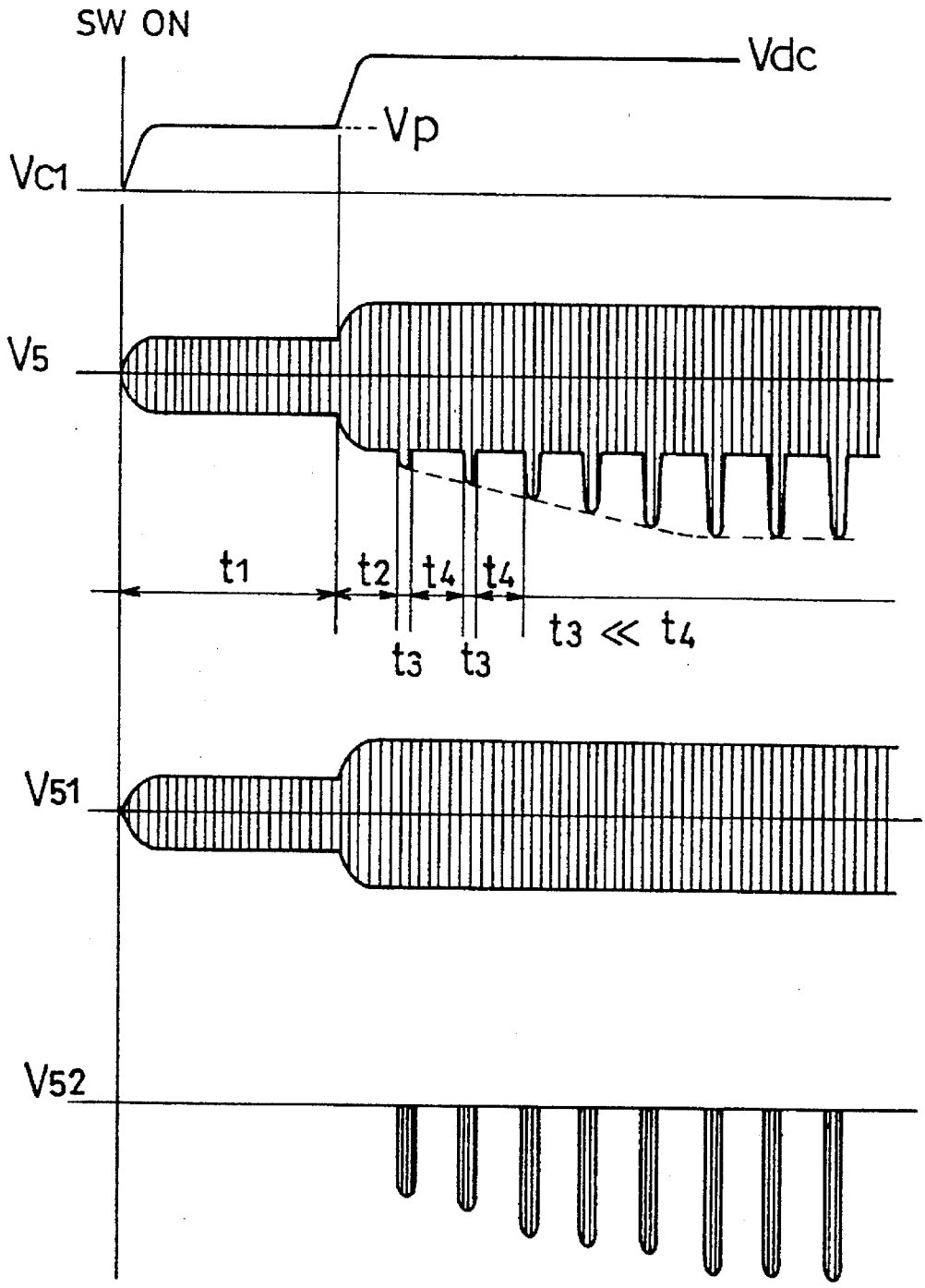
FIG. 16 is an operational waveform diagram for another embodiment according to the present invention.

Referring now to FIG. 14, there is shown in a block diagram another embodiment of the discharge lamp lighting device according to the present invention, in which, in contrast to the embodiment of FIG. 3, a series circuit of a DC voltage source Va and a diode D7 is inserted in the load circuit to be in parallel to the pulse generating circuit 17. In this case, an application of any higher voltage than a DC source voltage Va from the pulse generating circuit 17 causes this higher voltage to be clamped by the diode D7, so as not to allow any voltage exceeding the DC source voltage Va to be applied to the discharge lamp (see FIG. 15). When the voltage $V_5$ applied to the discharge lamp 15 is the voltage required for starting the lighting of the discharge lamp, the operating timing of the chopper circuit 11 and pulse generating circuit 17 may be the same as that in the foregoing embodiments. For the pulse-shaped voltage to be applied during the low light-flux dimming lighting, it is also possible to supply the asymmetrical pulse-shaped voltage, similarly to the case of starting the lighting, so long as the voltage is at the required voltage level for the low light-flux dimming lighting, and to apply the symmetrical pulse-shaped voltage upon the dimming lighting with a resetting function provided. Further, with the DC source voltage made Va=0, such operationally symmetrical pulse-shaped voltage as shown in FIG. 16 may be applied to the discharge lamp 15 only in one direction.

Figure 17:
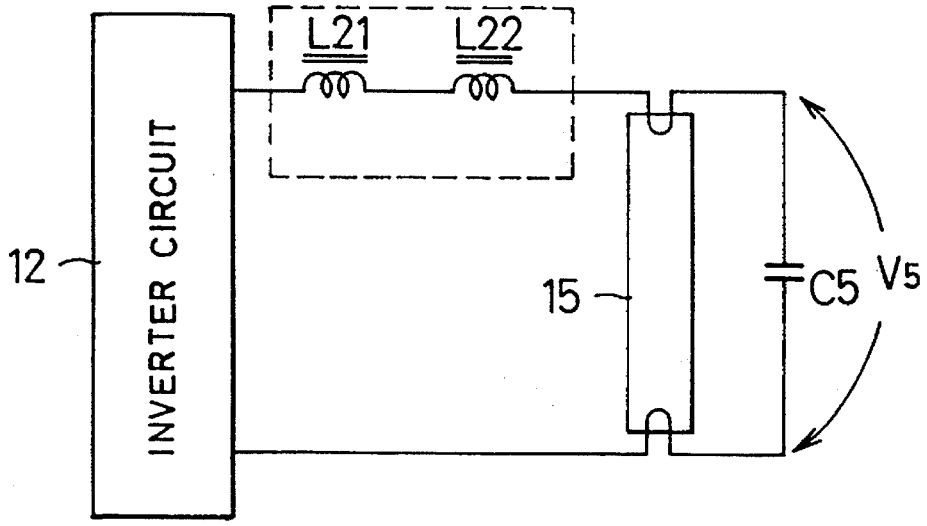
FIGS. 17 to 19 are schematic circuit diagrams of the discharge lamp lighting device in further embodiments according to the present invention.

In FIG. 17, there is shown in a block diagram the discharge lamp lighting device in another embodiment according to the present invention, in which an output voltage of the inverter circuit 12 is applied through a series circuit of inductors L21 and L22 to a parallel circuit of the discharge lamp 15 and capacitor C5. To the inductors L21 and L22 connected in series to the discharge lamp 15, there is applied a balance voltage of a reduction of the lamp voltage $V_5$ applied to the discharge lamp 15 from the output voltage of the inverter circuit 12. In this case, it is possible to weaken the intensity of magnetic field generated by the inductor as a current limiting element which is provided as divided into the two inductors L21 and L22, when compared with a case where a single inductance is employed, and the noises occurring at the discharge lamp or its environmental elements can be remarkably reduced. Further, while the division of the inductor into two is exemplified here, the inductor as the current limiting element may be divided into n elements which are more than three, so that generated noises upon executing the dimming lighting can be remarkably restrained.

Figure 18:
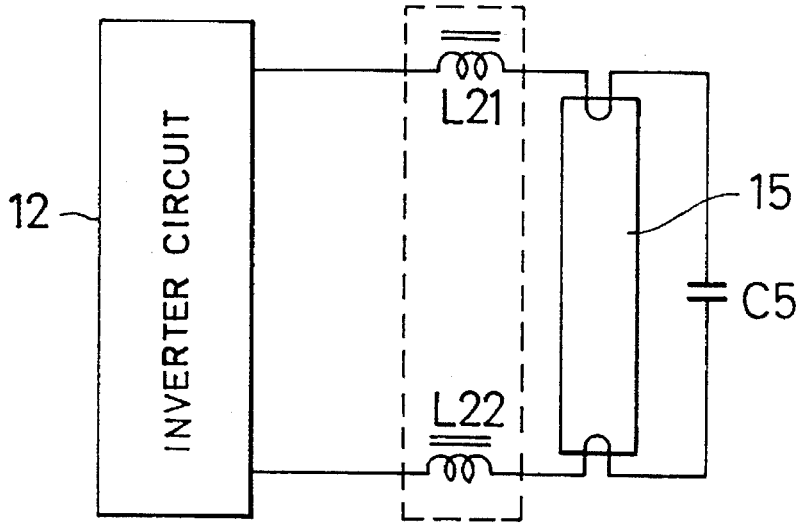

In another embodiment shown in a block diagram of FIG. 18 of the discharge lamp lighting device according to the present invention, the two divided inductors L21 and L22 are inserted so as to be on both sides of the discharge lamp 15, whereby the voltage across the discharge lamp 15 can be stabilized, and the generated noises at the discharge lamp 15 can be reduced.

Figure 19:
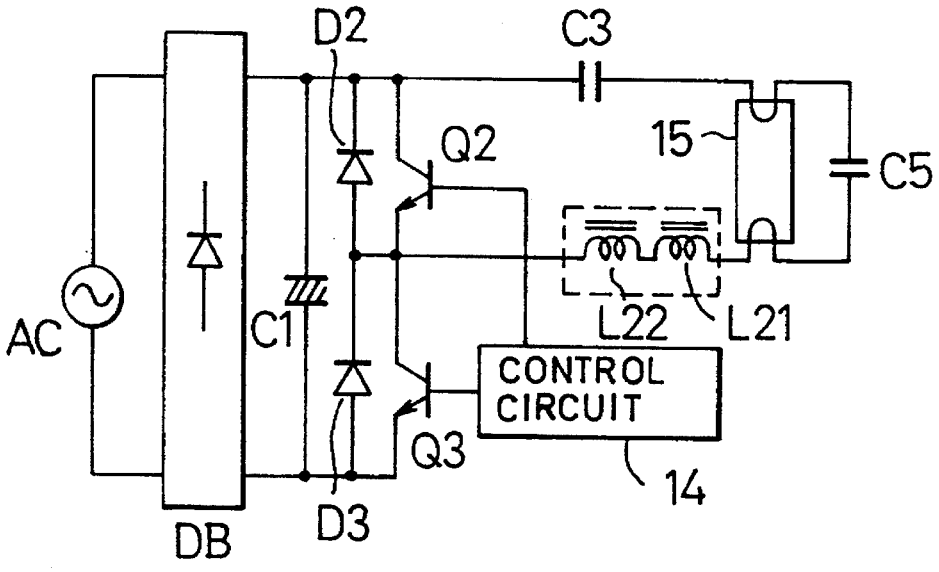

FIG. 19 is a circuit diagram showing the discharge lamp lighting device in another embodiment according to the present invention, in which the two divided inductors L21 and L22 are connected mutually in series and connected between one filament of the discharge lamp 15 and the junction point between the diodes D2 and D3 connected in parallel to the smoothing capacitor C1, and the noises can be sufficiently reduced by the lamp current flowing through the discharge lamp.

Figure 20:
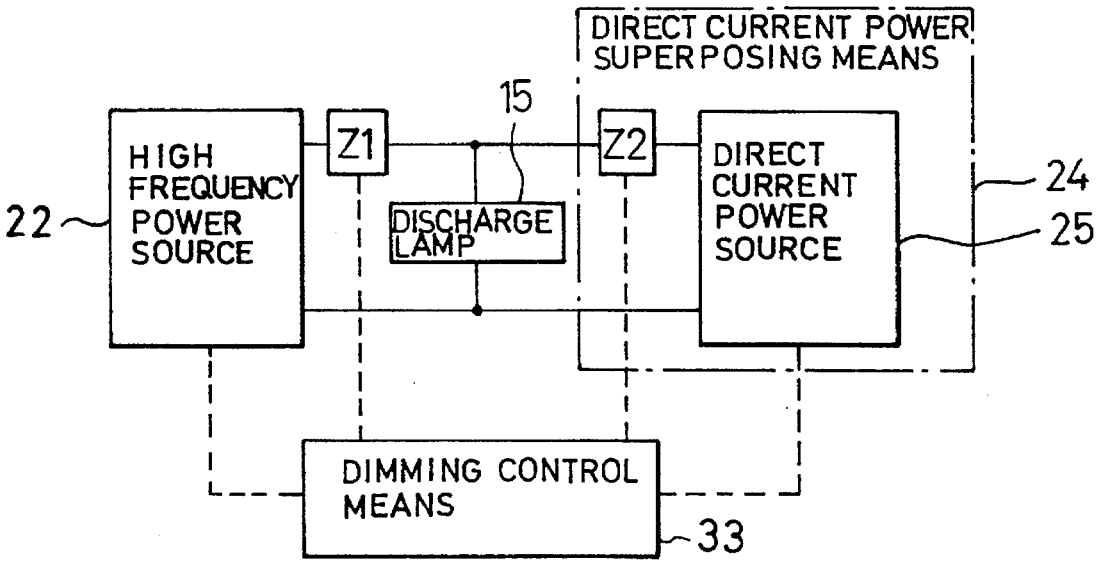
FIGS. 20 and 21 show in block circuit diagrams a basic arrangement of the discharge lamp lighting device in another embodiment according to the present invention.
Figure 21:
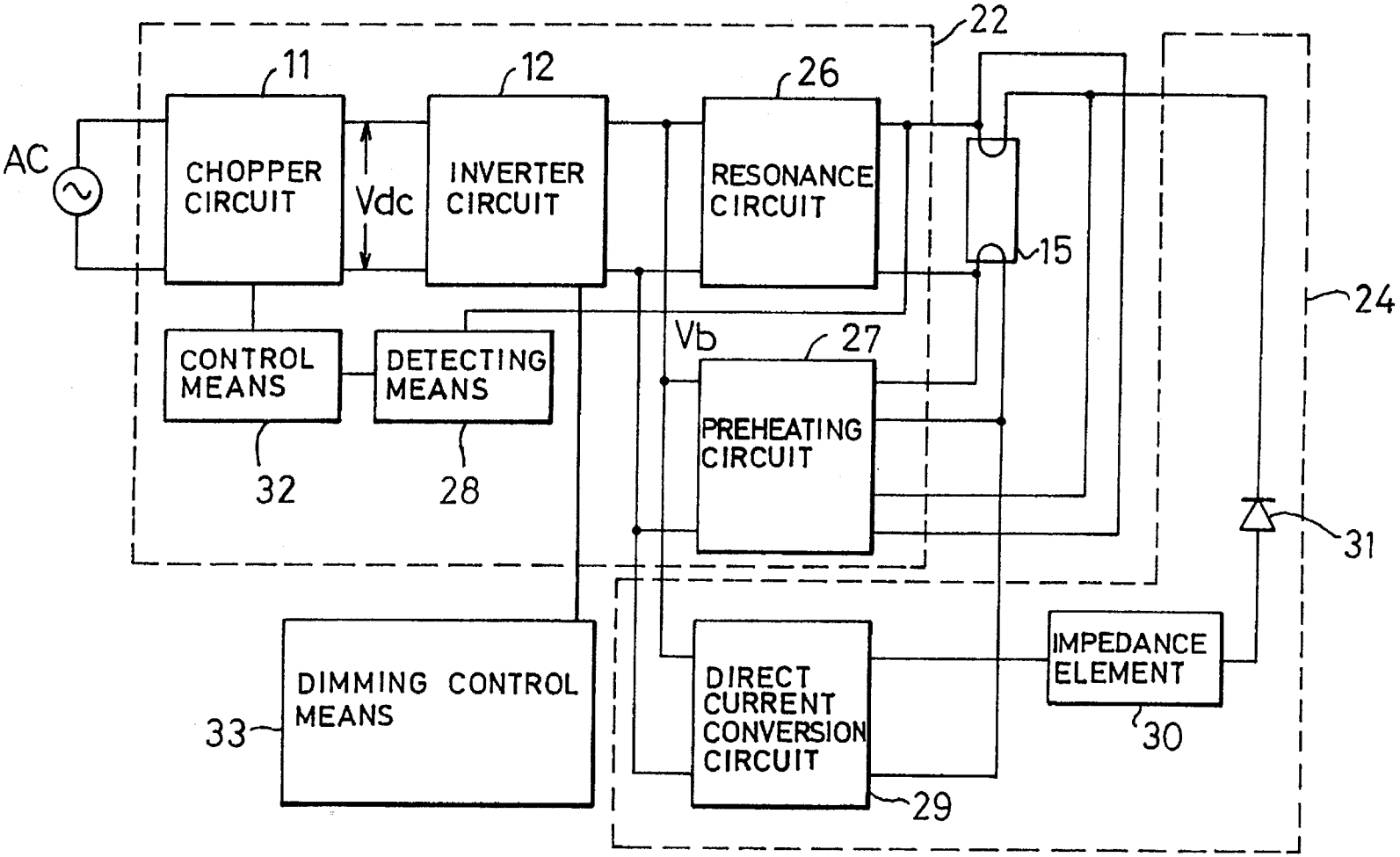

In FIG. 20, still another embodiment of the discharge lamp lighting device according to the present invention is shown in a block diagram, which also adopts an arrangement for realizing in smooth manner the dimming lighting down to the low light-flux range. The device of this embodiment is provided with a high frequency power source 22 and a DC power superposing means 24, while details of the high frequency power source 22 are shown in FIG. 21. Thus, the high frequency power source 22 comprises the chopper circuit 11 for converting the source voltage from the AC source AC into the DC voltage Vdc, the inverter circuit 12 for converting the DC voltage Vdc into a high frequency, a resonance circuit 26 for applying the high frequency output of the inverter circuit 12 to the discharge lamp 15, a preheating circuit 27 for preheating the filaments of the discharge lamp 15 by utilizing the high frequency output of the inverter circuit 12, a detecting means 28 for detecting the lamp voltage Vb to the discharge lamp 15, and a control means 32 for feedback controlling the chopper circuit 11 with an output of the detecting means 28. The DC power superposing means 24 comprises a series circuit of a DC conversion circuit 29 for generating a DC voltage with the high frequency output of the inverter circuit 12 utilized, an impedance element 30 for supplying the output DC voltage of the DC conversion circuit 29 to the discharge lamp 15, and a diode 31.

Figure 22:
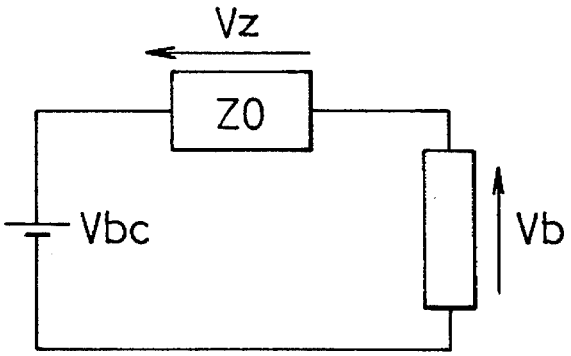
FIGS. 22 to 26 are explanatory waveform diagrams for the operation in the arrangement of FIGS. 20 and 21.

This arrangement of FIGS. 20 and 21 involves, however, a problem required to overcome. That is, in an event where the DC voltage Vdc is much higher than the lamp voltage Vb, to be Vdc>>Vb, an equivalent circuit presented with the impedance of the inverter circuit 12 and resonance circuit 26 made ZO will be as shown in FIG. 22, and there is satisfied an equation Vdc=Vz+Vb. Accordingly, the higher the DC voltage Vdc than the lamp voltage Vb, the larger a voltage drop Vz due to the impedance ZO, upon which there arises a risk that the voltage applied to the inverter circuit 12 and resonance circuit 26 becomes higher, the power consumed at this circuit part increases by an extent in which the voltage has been elevated, and the circuit efficiency is lowered thereby.

Figure 23:
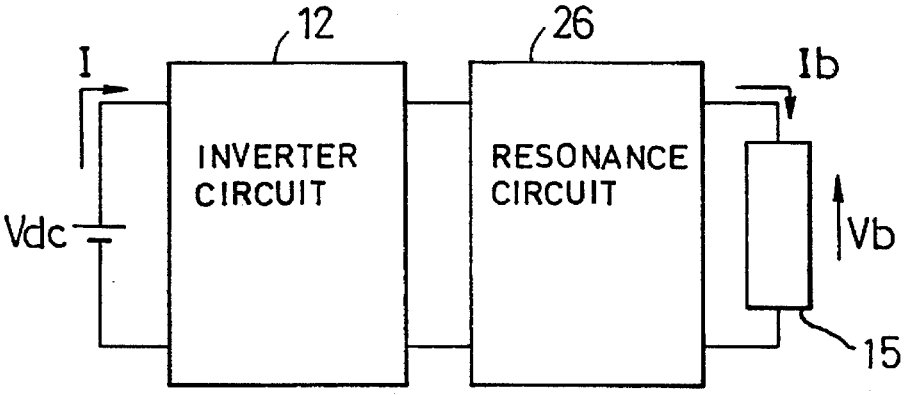

In an event where the DC voltage Vdc is much lower than the lamp voltage Vb, to be Vdc<<Vb, referring thereto with reference to FIG. 23, the power consumed at the discharge lamp 15 (Wb=Vb×Ib) will be substantially constant irrespective of the value of the DC voltage Vdc so long as the luminosity of the discharge lamp 15 is identical. In supplying an identical power to the discharge lamp 15, here, the input current is increased when the DC voltage Vdc is lower. In an event where the DC voltage Vdc is lower than the lamp voltage Vb, to be Vdc<Vb, it is necessary to elevate the voltage so as to be able to obtain the desired lamp voltage Vb by intensifying the resonance, upon which the resonance current increases to enlarge the reactive power, and the efficiency is lowered. It will be thus appreciated that the efficiency is lowered in either event where the DC voltage Vdc is excessively high or low.

Figure 24:
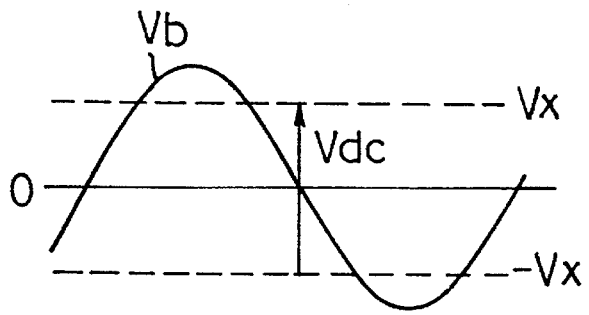

As has been described, the relationship between the DC voltage Vdc and the circuit efficiency is determined by the value of the lamp voltage Vb. Therefore, by setting the value of the DC voltage Vdc in accordance with the lamp voltage Vb, it is made possible to provide the discharge lamp lighting device excellent in the circuit efficiency. Considering the optimum value of the DC voltage Vdc, which is as shown in FIG. 24, an effective value of the lamp voltage Vb denoted by Vx is as shown in FIG. 24 by broken lines. Here, a setting of the DC voltage Vdc so as to be Vdc=2Vx as shown in the drawing renders the efficiency to be at the best value, without causing the DC voltage Vdc to become excessively high or low with respect to the lamp voltage Vb. In practice, however, the inverter circuit 12 and resonance circuit 26 are holding the impedance component ZO so that, taking this into account, it will be required to set the DC voltage to be Vdc=2Vx+Vz, and it will be practically optimum to set the DC voltage Vdc to be about 2.0 to 2.5 times as high as the effective value Vx of the lamp voltage.

Figure 25:
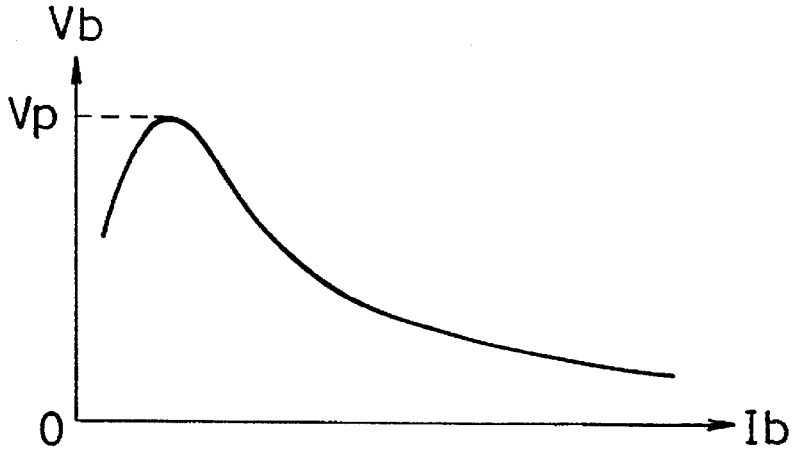

In executing the dimming lighting, further, the lamp voltage Vb is also caused to be varied in accordance with the lamp current Ib, as shown in FIG. 25. In this case, there remains a risk to arise such that the circuit efficiency is lowered depending on the degree of dimming. That is, it is likely that the lamp power is decreased at the time of the dimming lighting according to the extent of the dimming in comparison with the full lighting, but the power consumed at the inverter circuit 12 or the like is to be less varied, and the lower flux of light, the more decrement in the circuit efficiency. Here, so far as the value of the DC voltage Vdc is set in accordance with the peak value Vp (effective value) of the lamp current Ib, the circuit efficiency can be retained excellent even under the low flux of light. That is, when the peak value in the effective value of the lamp voltage Vb is made to be Vp as seen in FIG. 25, then the DC voltage will be Vdc= Vp+Vz. In practice, the DC voltage Vdc is so set as to be about 2.0 to 2.5 times as high as the peak value Vp in the effective value of the lamp voltage Vb.

Referring again to FIG. 21, a feedback control of the DC voltage Vdc is carried out so that Vdc=Vp+Vz with respect to the peak value Vp in the effective value of the lamp voltage Vb in the present embodiment, as shown in FIG. 25. In carrying out a dimming control of a discharge lamp (FLR-40), for example, this lamp FLR-40 shows that the peak value of the lamp voltage Vb under the dimming lighting rises to be about 180 V, at the time of a low temperature. When the value of the DC voltage Vdc (=Vp+Vz) is set to be about 360 V to 450 V, here, it is possible to render the circuit efficiency to be extremely excellent and a continuous dimming to be carried out over a wide range. In the present embodiment, further, the inverter circuit employable may be either of a half-bridge type or a full-bridge type. When, on the other hand, a single stone type inverter circuit is employed, this circuit has a boosting action, and the formula Vdc=Vp+Vz is not applicable. Further, while the chopper circuit 11 employed is of a boosting type, any chopper circuit of other arrangement may equally be employed so long as the predetermined DC voltage Vdc can be thereby obtained.

Figure 26:
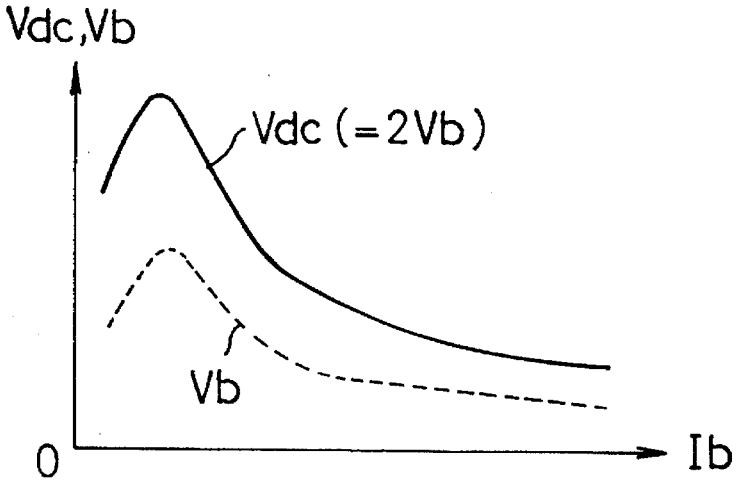

In the above described embodiment, the DC voltage Vdc is set by means of the peak value Vp of the lamp voltage Vb at the time of the dimming lighting so that, when the optical output of the discharge lamp 15 is high (the lamp voltage Vb is low), the circuit efficiency will be lowered. Taking this into account, therefore, the circuit efficiency can be elevated not only in the low light-flux range but also in the case of full lighting by varying the DC voltage Vdc by means of the detecting means 28 for detecting the effective value Vx of the lamp voltage Vb, so as to have the relationship Vdc=2.0 to 2.5 Vx always satisfied. An example of the relationship between the DC voltage Vdc and the lamp current Ib is shown in FIG. 26, in which the value of the DC voltage Vdc is always 2 Vb irrespective of variation in the output flux of light, and the dimming lighting down to a considerably low flux of light can be realized in a smooth manner.

Figure 27:
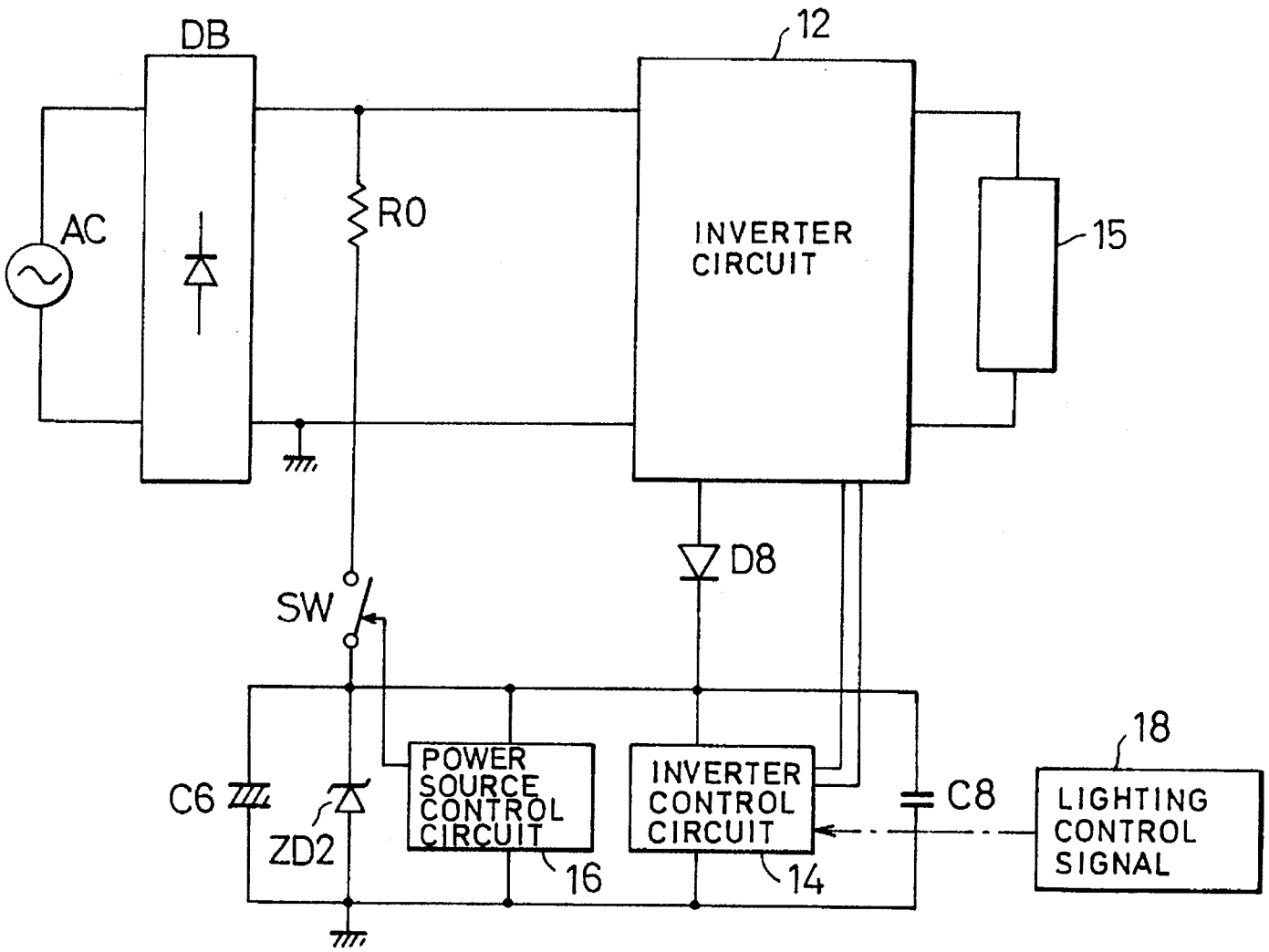
FIG. 27 is a block circuit diagram showing a basic arrangement of the discharge lamp lighting device in another embodiment according to the present invention.
Figure 28:
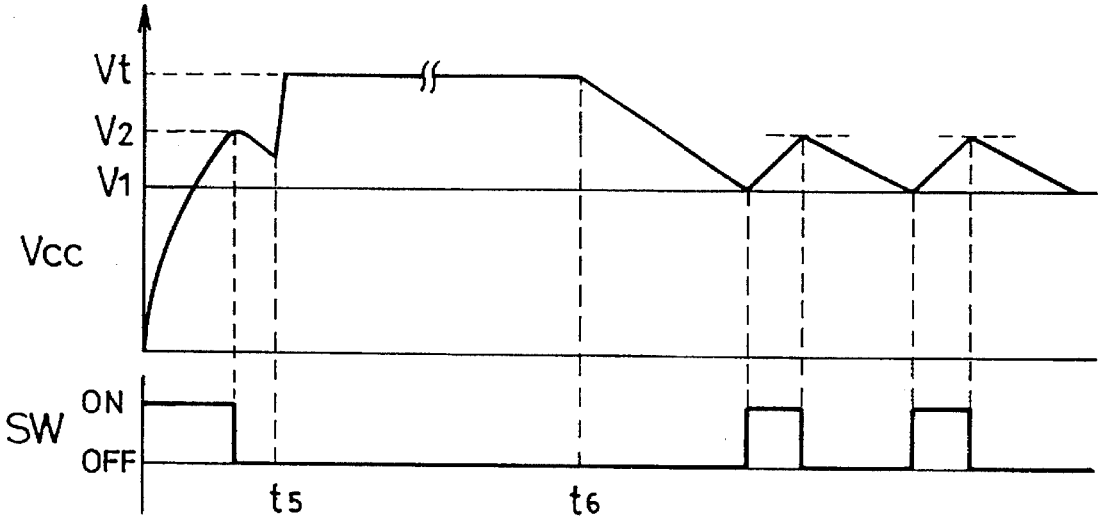
FIG. 28 is an explanatory waveform diagram for the operation in the embodiment of FIG. 27.

Referring to FIG. 27, there is shown a basic arrangement of the discharge lamp lighting device in another embodiment according to the present invention. Describing the operation of this arrangement by reference also to FIG. 28, a turning ON of the source switch SW causes a control source voltage Vcc to rise through a resistor RO and to elevated up to a voltage $V_2$. When the source switch SW is turned OFF after the elevation of the voltage Vcc to the voltage $V_2$, the control source voltage Vcc is lowered. Provided here that the inverter circuit 12 initiates its operation at a time $t_5$, a current for the control source is supplied from the inverter circuit 12 through a diode D8, and the control source voltage Vcc is raised to the highest value Vt, which value is to be a Zener voltage of a Zener diode ZD2. While in FIG. 28 the inverter circuit 12 is shown to initiate its operation at the time $t_5$, an initiation of the operation at an earlier time causes the current supply through the diode D8 to be started at the earlier initiation time, and the control source voltage Vcc is thereby raised.

For a period in which the control source voltage Vcc is higher than the voltage $V_2$, the source switch SW maintains the OFF state. As a light-off control signal is input at a time $t_6$, the inverter circuit 12 stops its operation, the current through the diode D8 ceases, the control voltage Vcc is lowered due to the consumption at the inverter control circuit 14, and the voltage $V_1$ is reached, upon which the source switch SW is turned 0N again and until the control source voltage Vcc is thereby raised to reach the voltage $V_2$, and the source switch SW is turned OFF as the voltage $V_2$ is reached. Thereafter, the control source voltage Vcc is controlled between both voltages $V_1$ and $V_2$. Here, the voltage $V_1$ is a voltage at which the operation of the inverter control circuit 14 is performed normally and, with a voltage above this voltage $V_1$, the inverter circuit 12 also starts normally operating. It should be appreciated that, with such control performed, the control source voltage Vcc in waiting state can be controlled to be low, and a power loss at the resistor RO can be reduced.

Figure 29:
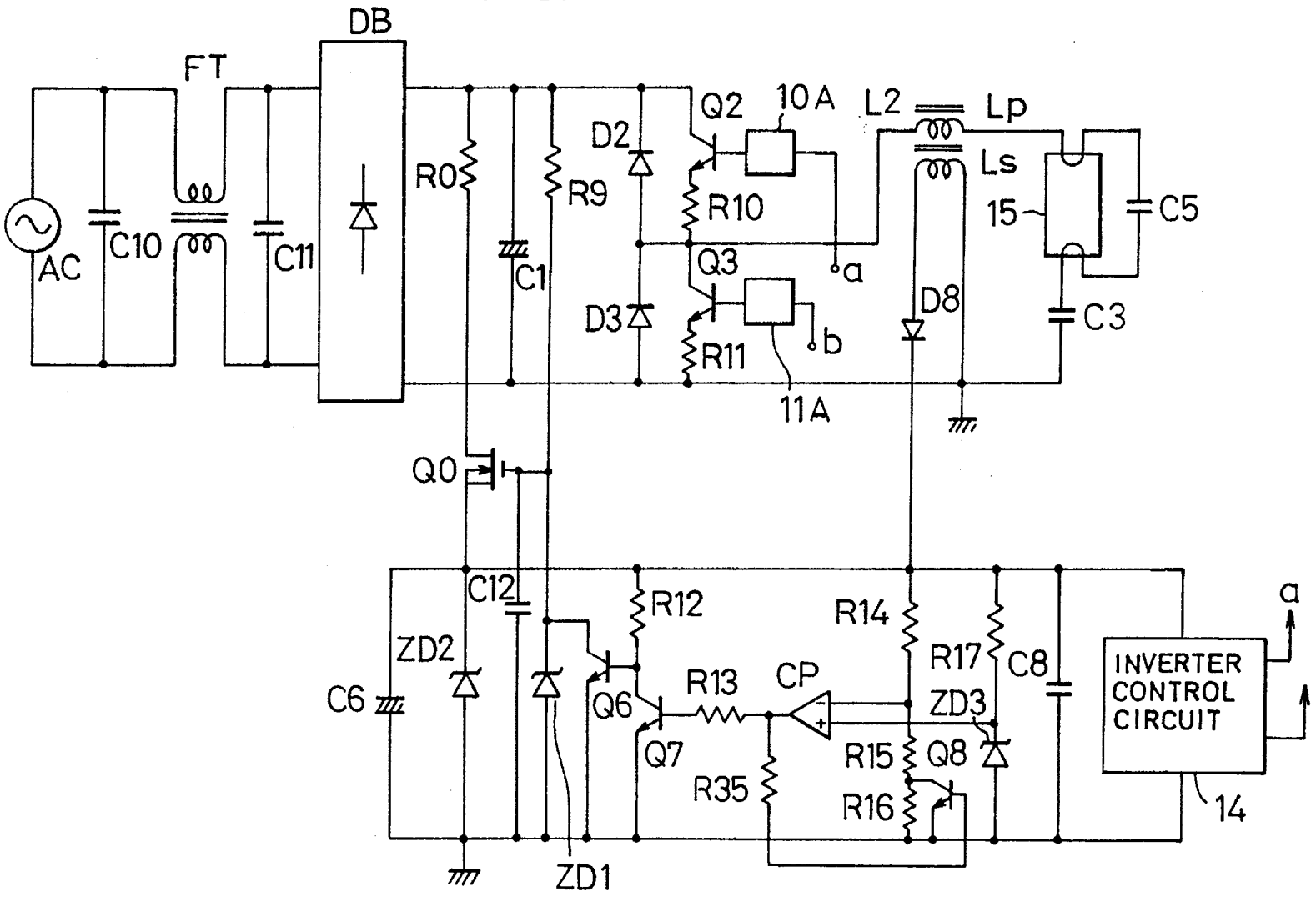
FIG. 29 is a detailed circuit diagram embodying the basic arrangement shown in FIG. 27.

In FIG. 29, there is shown a concrete circuit arrangement of the present embodiment, in which the AC source AC is connected, through a low-pass filter circuit comprising capacitors C10 and C11 and a filter coil FT, to the AC input end of the full-wave rectifier DB, to the DC output end of which rectifier the smoothing capacitor C1 is connected in parallel, and a series circuit of the transistors Q2 and Q3 is connected across the capacitor C1. To emitters of these transistors Q2 and Q3, resistors R10 and R11 are respectively connected in series. To a series circuit of the transistor Q2 and resistor R10, a diode D2 is connected in reverse parallel relationship, and, to a series circuit of the transistor Q3 and resistor R11, a diode D3 is connected in reverse parallel relationship. To the series circuit of the transistor Q2 and resistor R10, the source side terminals of the filaments of the discharge lamp 15 are connected through the choke coil L2 and capacitor C3, while the capacitor C5 is connected across non-source side terminals of the filaments of the discharge lamp 15 in parallel relationship, and the output voltage of the inverter control circuit 14 is applied to the bases of the transistors Q2 and Q3, respectively through each of driving circuits 10A and 11A.

Across the smoothing capacitor C1, the capacitor C6 is connected through a current limiting resistor RO and a MOS transistor QO, while a Zener diode ZD2 is connected across the capacitor C6 in parallel relationship. Further, across the smoothing capacitor C1, a parallel circuit of a capacitor C12 and Zener diode ZD1 is connected through a resistor R9. A potential obtainable at the capacitor C12 is provided to the gate of the MOS transistor QO. The secondary winding Ls of the choke coil L2 is grounded at an end while the other end of the winding Ls is connected to a capacitor C8 through a diode D8. This capacitor C8 is connected in parallel to the capacitor C6, to constitute a power source for the inverter control circuit 14. Across the capacitor C8, a Zener diode ZD3 is connected through a resistor R17, as well as a series circuit of resistors R14, R15 and R16, A junction point between the resistors R14 and R15 is connected to a negative input-terminal of a comparator CP, while a junction point between the resistor R17 and the Zener diode ZD3 is connected to a positive input terminal of this comparator CP, an output terminal of which is connected through a resistor R35 to the base of a transistor Q8 and through a resistor R13 to the base of a transistor Q7. The transistor Q8 is connected in parallel across the resistor R16, and the transistor Q7 is connected between the base and the emitter of a transistor Q6 which can be pulled up at the base through a resistor R12 at the potential of the capacitors C6 and C8, while the transistor Q6 is connected in parallel and across the Zener diode ZD1.

Referring now to the operation of this circuit of FIG. 29, the control source voltage Vcc obtained by the capacitors C6 and C8 is applied to the series circuit of the resistor R17 and Zener diode ZD3, and a reference voltage obtained at the Zener diode ZD3 is provided to the positive input terminal of the comparator CP. Further, the control source voltage Vcc is divided at the resistors R14–R16 and is provided to the negative input terminal of the comparator CP. As will be clear from FIG. 28, the comparator CP provides a high level output when $Vcc<V_2$, whereby the transistor Q7 is turned ON while the transistor Q6 is turned OFF, and the MOS transistor Q0 is also made ON. When $Vcc \geqq V_2$, the comparator CP is inverted so that its output will be at low level, the transistor Q7 turns OFF, while the transistor Q6 turns ON, and the MOS transistor Q0 is made OFF. By so setting the circuit constant of the resistors R14–R16 and Zener diode ZD3 that the output of the comparator CP will be at the high level again as the control source voltage Vcc is lowered to be $Vcc \leqq V_2$, then the same operation as that has been referred to with reference to FIG. 28 can be attained.

Figure 30:
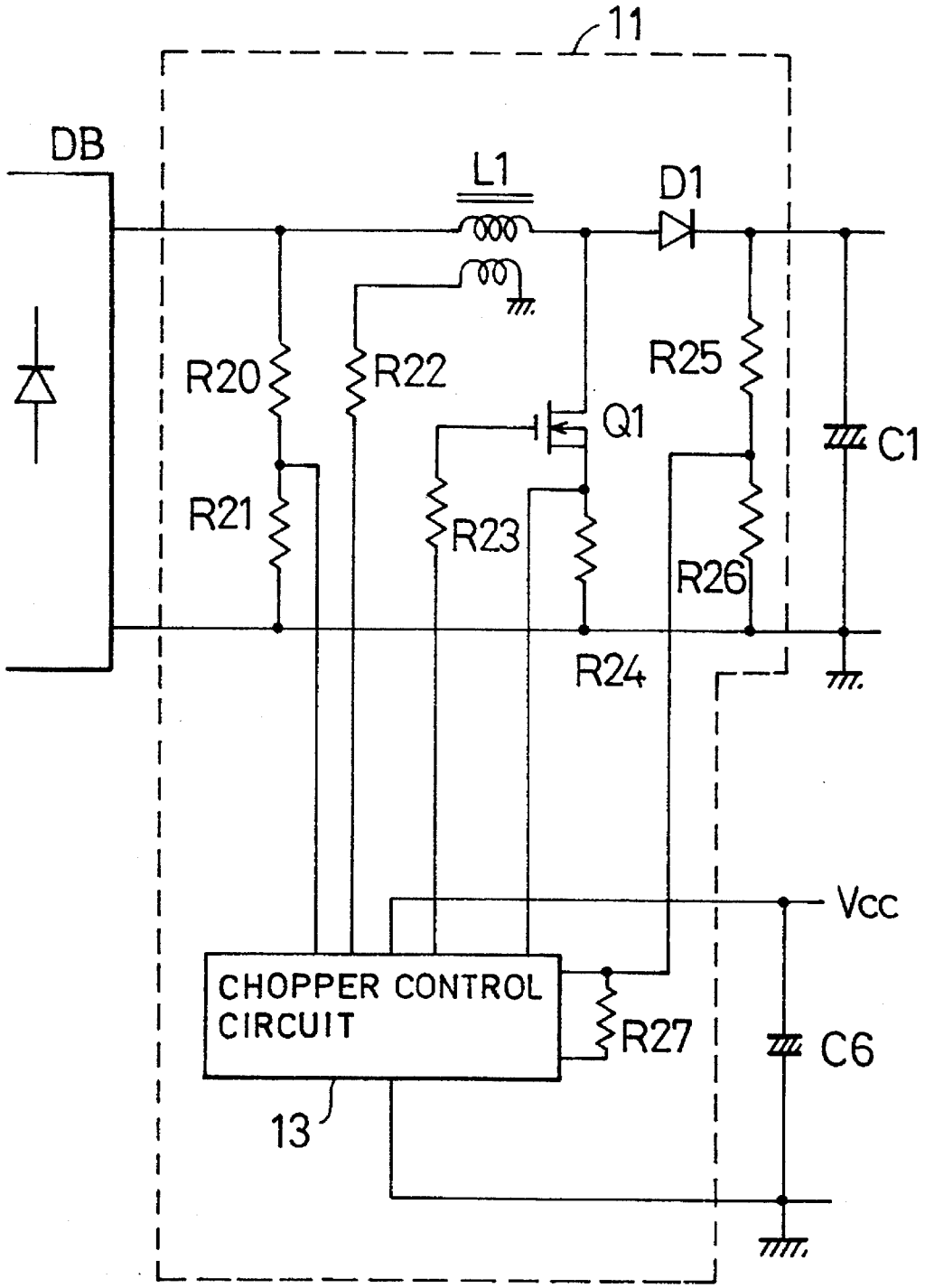
FIG. 30 is a circuit diagram showing the discharge lamp lighting device in another embodiment according to the present invention.

Referring to FIG. 30, there is shown a circuit diagram of an essential part in another embodiment of the discharge lamp lighting device according to the present invention, in which the boosting chopper circuit 11 is inserted, in the above described embodiment of FIG. 29, between the output terminals of the full-wave rectifier DB and the smoothing capacitor C1. In this case, the smoothing capacitor C1 is connected through the series circuit of the choke coil L1 and diode D1 to the output terminals of the full-wave rectifier DB, while a series circuit of the MOS transistor Q1 and resistor R24 is connected to a series circuit of the diode D1 and capacitor C1. The output voltage of the full-wave rectifier DB is divided by a series circuit of resistors R20 and R21 and is provided to the chopper control circuit 13. The current flowing to the choke coil L1 is detected by a secondary winding of this choke coil L1 and is provided through a resistor R22 to the chopper control circuit 13. The output of the chopper control circuit 13 is provided through a resistor R23 to the gate of the MOS transistor Q1, and the current thus flowing to this transistor Q1 is detected by the resistor R24 and provided to the chopper control circuit 13. The voltage at the capacitor C1 is divided by resistors R25 and R26 and provided to the chopper control circuit 13, and this circuit 13 performs the ON/OFF control of the MOS transistor Q1 so that a predetermined voltage can be obtained at the smoothing capacitors C1. Here, the MOS transistor Q0 shown in the circuit of FIG. 29 is connected at its drain, through a resistor R10, to one output terminal on higher potential side of the full-wave rectifier DB.

Now, the relationship between the operational voltage Ve and the control source voltage Vcc of the chopper control circuit 13 shall be considered. When the control source voltage Vcc is lower than the operational voltage Ve of the chopper control circuit 13, the operation of this circuit 13 is stopped. In the case where the chopper circuit 11 is of the boosting type and so long as the chopper circuit 11 is always in the operating state, the input voltage to the inverter circuit 12 is made always high and the chopper control circuit 13 involves an unnecessary power loss, so that it will be the optimum that the voltages will be $V_2<Ve<Vt$ in FIG. 28. With such voltage setting, the operation of the chopper circuit 11 is started after the starting of the inverter circuit 12. When on the other hand the inverter circuit 12 is in waiting state, there is the relationship $V_1<Vcc<V_2$, the chopper circuit 11 stops its operation automatically.

While the chopper circuit 11 in the present embodiment has been referred to as being of the boosting type, it may also be possible to employ any voltage dropping type or boosting and dropping type chopper circuit may be obtained. When the dropping type is employed, the input voltage to the inverter circuit 12 is not made high even when the chopper circuit 11 is in constant operating state, and the voltages may be set to be $V_1>Ve$. Since the voltages are in the relationship of $Vcc>V_1$ upon stopping of the inverter circuit 12 due to the above arrangement employed, the operation of the chopper circuit 11 is continued. Accompanying this, the voltage supply to the inverter circuit 12 upon restarting of the inverter circuit 12 can be stably performed.

Figure 31:
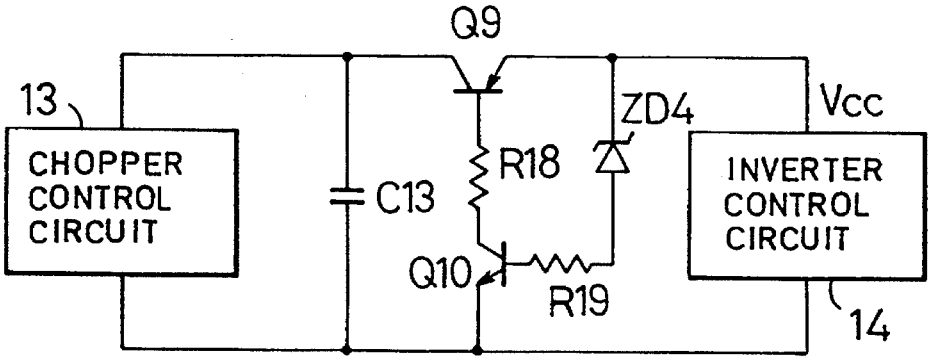
FIG. 31 shows in a circuit diagram another embodiment of the discharge-lamp lighting device according to the present invention.

In another embodiment of the discharge lamp lighting device according to the present invention as shown in FIG. 31, the arrangement is so made that the power supply to the chopper control circuit 13 is controlled by ON/OFF operation of a transistor Q9. As the control source voltage Vcc supplied to the inverter control circuit 14 exceeds a predetermined value, a current is caused to flow through a Zener diode ZD4 to the base of another transistor Q10, the transistor Q9 is thereby turned ON, and a power is supplied to the chopper control circuit 13. As the control source voltage becomes below the predetermined value, the Zener diode ZD4 is turned OFF, on the other hand, the transistor Q10 is also made OFF and the transistor Q9 is made OFF reliably. Accordingly, with the Zener voltage of the Zener diode ZD4 properly set, it is made possible to stop reliably the power supply to the chopper control circuit 13 when the control source voltage Vcc is lower than the set value.

Figure 32:
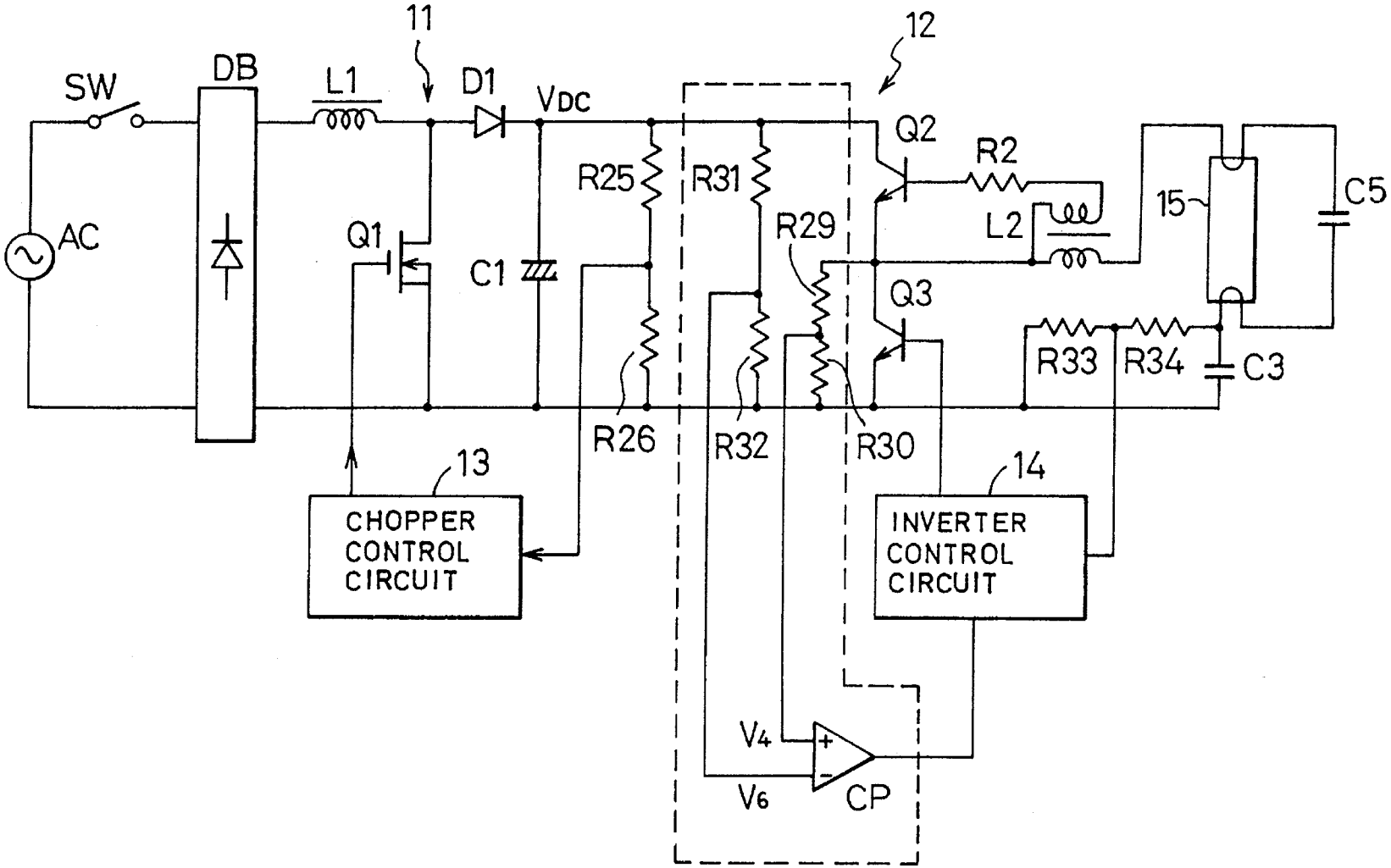
FIG. 32 is a circuit diagram showing another embodiment of the discharge lamp lighting device according to the present invention.
Figure 33:
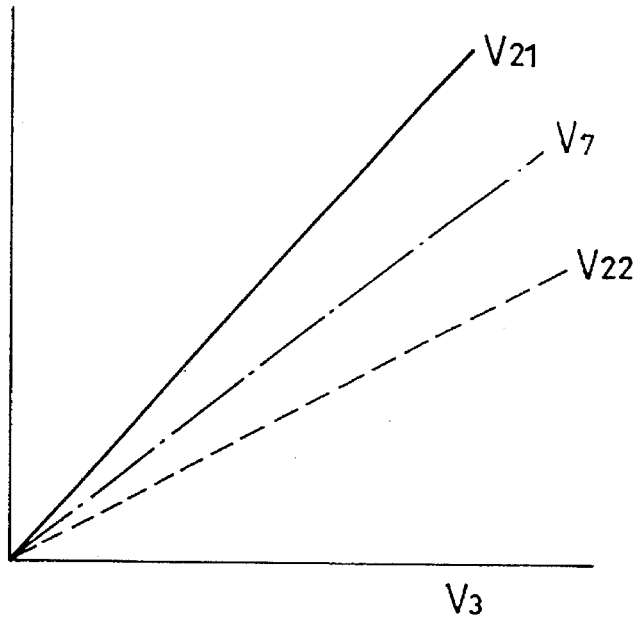
FIG. 33 is an explanatory waveform diagram for explaining the operation in the embodiment of FIG. 32.
Figure 34:
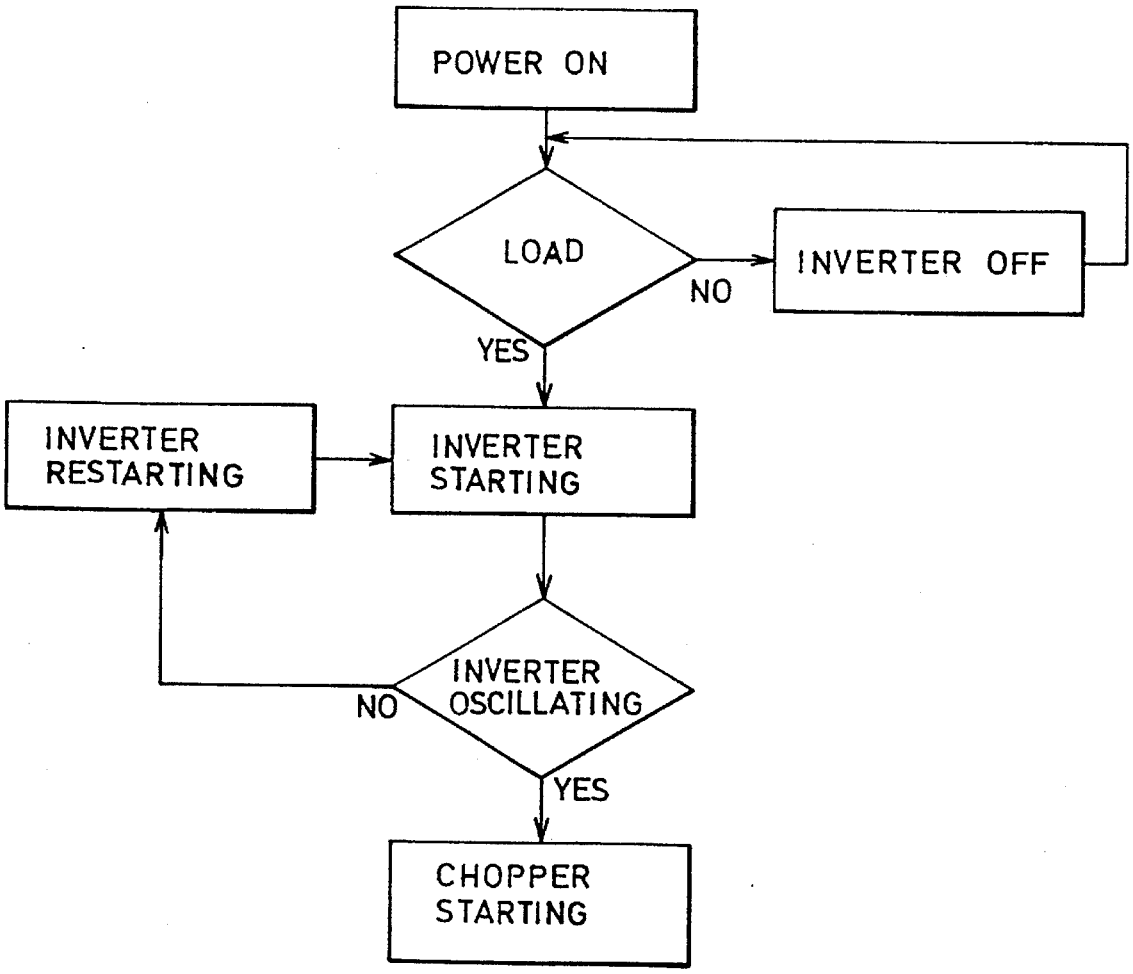
FIG. 34 is a flow-chart showing the operation in the embodiment shown in FIG. 32.

In FIG. 32, there is shown another embodiment of the discharge lamp lighting device according to the present invention, in which the boosting type chopper circuit 11 has the inductor L1 and switching element Q1 connected in series to the DC output terminals of the full-wave rectifier DB, and the smoothing capacitor C1 is connected through the diode D1 across the switching element Q1. With repetition of the ON/OFF operation at a high frequency of the switching element Q1, at this time, a voltage is induced across the inductor L1, this voltage is superposed on the output voltage of the full-wave rectifier DB so as to be charged in the smoothing capacitor C1 through the diode D1. The voltage obtained at the smoothing capacitor C1 is divided by the resistors R25 and R26 and subjected to a feedback to the chopper control circuit 13, and the switching element Q1 is made for ON/OFF operation. The output voltage of the chopper circuit 11 is made to be about 400 V, for example, and the full-wave rectifeid voltage from the AC source is provided to the inverter circuit 12 in non-operating period of the chopper circuit 11. That is, when the Ac source voltage is 100 V, the input voltage $V_3$ to the inverter circuit is varied in such wide range as 140 to 400 V. With respect to this input voltage $V_3$ varying over such wide range, a voltage $V_6$ obtained by dividing this input voltage by resistors R31 and R32 is provided as a reference voltage to the voltage comparator CP for a comparison with a voltage $V_4$ obtained by dividing a voltage at a junction point between the switching elements Q2 and Q3 by means of resistors R29 and R30. The reference voltage $V_7$ obtained by dividing the input voltage $V_3$ is so set as to be, as shown in FIG. 33, intermediate between a voltage $V_{21}$ upon turning ON of the switching element Q2 and a voltage $V_{22}$ upon turning OFF of the switching elements Q2 and Q3. By means of such setting, the reference voltage $V_6$ of the voltage comparator CP operates to follow the variation in the input voltage $V_3$. Further, it is enabled to reliably realize the detection of turning ON of the switching element Q3 as well as turning OFF of the switching elements Q2 and Q3 (see FIG. 34).

In the respective embodiments of FIGS. 3, 5–14, 16–19, 22–26, 29–32 and 34, all other arrangements than those described with reference to the drawings are the same as or equivalent to those of the embodiment of FIG. 1, and the same functions and effect can be likewise attained.

What is claimed is:

1. A discharge lamp lighting device comprising:

a discharge lamp;

an alternating current (AC) power source generating an AC signal;

means for converting the AC signal into a direct current (DC) signal;

means for converting the DC signal into a high frequency AC signal having a first frequency, for applying the high frequency AC signal to the discharge lamp, for controlling the high frequency AC signal to have first, second, third, and fourth amplitudes during respective first (t1), second (t2), third (t3) and fourth (t4) periods, for warming the discharge lamp during the first period t1, for controlling the third amplitude to be greater than the fourth amplitude, for controlling the fourth period t4 to be substantially longer than the third period t3 (i.e., t4>>t3), for alternately applying the third voltage for the third period and then the fourth voltage for the fourth period to intermittently apply a pulse-shaped voltage to the discharge lamp at a second frequency less than the first frequency, for varying at least one of the third and fourth amplitudes to dim the discharge lamp, and for gradually increasing the third amplitude until the discharge lamp is started while avoiding a flash.

2. The device according to claim 1, wherein said means for converting the DC signal is arranged to generate said pulse-shaped voltage after ON/OFF operation and to stabilize the pulse-shaped voltage with said peak value elevated.

3. The device according to claim 1, wherein said means for converting the DC signal is provided for ON/OFF operation at the time when said pulse-shaped voltage is generated.

4. The device according to claim 2, wherein said means for converting the AC signal is provided for starting ON/OFF operation thereof prior to stabilization in said peak value of said pulse-shaped voltage.

5. The device according to claim 2, wherein said means for converting the AC signal is provided for starting ON/OFF operation thereof immediately before stabilization in said peak value of said pulse-shaped voltage.

6. The device according to claim 1, wherein said means for converting the AC signal is provided for starting ON/OFF operation thereof upon stabilization in said peak value of said pulse-shaped voltage.

7. The device according to claim 1, wherein said means for converting the AC signal is provided for starting ON/OFF operation thereof after stabilization in said peak value of said pulse-shaped voltage.

8. The device according to claim 1, wherein said means for converting the AC signal provides said direct current signal in a DC output voltage varied in a plurality of stages.

9. The device according to claim 8, wherein said DC output voltage is varied at least two stages of starting said dimming lighting and during dimming.

10. The device according to claim 1, wherein said means for converting the DC signal is provided for a precedent preheating of said discharge lamp, said means for converting the AC signal is provided for ON/OFF operation subsequent to ON/OFF operation of the means for converting the DC signal, said means for converting the DC signal is provided for generating said pulse-shaped voltage subsequent to said operation of said means for converting the AD signal and for gradually raising said peak value of the pulse-shaped voltage until a stabilization of said lighting, and the device further comprises means for varying a DC output voltage of said direct current signal of the means for converting the AC signal so as to render the peak value of the pulse-shaped voltage to be substantially constant and to be a predetermined discharge lamp output.

11. The device according to claim 10, wherein said means for converting the DC signal is provided for supplying said pulse-shaped voltage at a level capable of maintaining said dimming lighting during dimming.

12. The device according to claim 1, wherein said means for converting the DC signal is provided for supplying said pulse-shaped voltage which is higher, during dimming, than that at starting of the dimming lighting, and for varying the pulse-shaped voltage during dimming.

13. The device according to claim 1, wherein said means for converting the DC signal is provided for said pulse-shaped voltage which is asymmetrical on positive and negative polarity sides.

14. The device according to claim 13, wherein said means for converting the DC signal is provided for maintaining the peak value of said pulse-shaped voltage at least on one of said positive and negative polarity sides to be at a predetermined value.

15. The device according to claim 1, wherein said means for converting the AC signal includes a boosting type chopper means, and said means for converting the DC signal includes a half-bridge type inverter means.

16. The device according to claim 1, wherein said means for converting the DC signal includes an inverter means, said means for converting the DC signal is provided for varying an output voltage of said inverter means.

17. The device according to claim 1, wherein said means for converting the AC signal includes a chopper means and a chopper control means for turning ON and OFF a power supply to said chopper means.

18. The device according to claim 17, which further comprises means for providing a control source voltage variable between two predetermined voltage values, said chopper control means being provided for an inverting operation when said control source voltage exceeds one of said predetermined voltage values.

19. The device according to claim 1, which further comprises means for obtaining a synchronous signal for an oscillation of said means for converting the AC signal in correspondence to input voltages over a wide range.

20. The device according to claim 1, which further comprises means for subjecting an output voltage of said means for converting the AC signal to a feedback control, with respect to a peak value of said voltage applied to said discharge lamp.

21. The device according to claim 1, wherein said means for converting the DC signal includes a resonating inductor which is divided into more than two.

* * * * *